US012296997B2

(12) United States Patent
Graef et al.

(10) Patent No.: US 12,296,997 B2
(45) **Date of Patent: *May 13, 2025**

(54) HAND HELD STRAPPING TOOL

(71) Applicant: SAMUEL, SON & CO. (USA) INC., Woodridge, IL (US)

(72) Inventors: Michael A. Graef, Warrenville, IL (US); Nathan C. Mellas, Warrenville, IL (US)

(73) Assignee: Samuel, Son & Co. (USA) Inc., Woodridge, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/924,358

(22) Filed: Oct. 23, 2024

(65) Prior Publication Data

US 2025/0058916 A1 Feb. 20, 2025

Related U.S. Application Data

(63) Continuation of application No. 17/514,142, filed on Oct. 29, 2021, now Pat. No. 12,145,755, which is a (Continued)

(51) Int. Cl.
*B66B 13/00* (2006.01)
*B65B 13/02* (2006.01)
(Continued)

(52) U.S. Cl.
CPC ..... *B65B 13/025* (2013.01); *B65B 13/186* (2013.01); *B65B 13/187* (2013.01); *B65B 13/322* (2013.01); *B65B 13/327* (2013.01)

(58) Field of Classification Search
CPC .. B65H 13/025; B65H 13/186; B65H 13/187; B65H 13/327; B65H 13/22; B65H 13/185; B65H 57/02
See application file for complete search history.

(56) References Cited

U.S. PATENT DOCUMENTS

1 A 7/1836 Ruggles
2 A 7/1836 Goulding
(Continued)

FOREIGN PATENT DOCUMENTS

AU 496889 B2 3/1975
BE 884778 A 12/1980
(Continued)

OTHER PUBLICATIONS

"Operating instructions" of the OR-T Battery-operated hand tool for plastic strapping, published in Mar. 2017 (28 pages).
(Continued)

*Primary Examiner* — Emmanuel M Marcelo
(74) *Attorney, Agent, or Firm* — Foley & Lardner LLP

(57) ABSTRACT

A strapping device includes a handle, a body, and an actuator. The handle includes an input device and a switch, the input device spaced from the switch by a biasing element that applies a bias force to the input device. The input device moves from a first state spaced from the switch to a second state contacting the switch responsive to receiving a force greater than the bias force. A circuit of the switch is closed responsive to the input device moving from the first state to the second state. The switch outputs an actuation signal responsive to the circuit being closed. The body includes a tensioner and a base including a strap receiver opposite the tensioner. The actuator moves the tensioner from a first tensioner position to a second tensioner position further from the strap receiver based on a movement force greater than the bias force.

30 Claims, 11 Drawing Sheets

Related U.S. Application Data continuation of application No. 16/277,574, filed on Feb. 15, 2019, now Pat. No. 11,174,051.

(51) Int. Cl.
*B65B 13/18* (2006.01)
*B65B 13/32* (2006.01)

(56) References Cited

U.S. PATENT DOCUMENTS 958,670 A 5/1910 Nilsen
1,600,833 A 9/1926 McChesney
1,950,477 A 3/1934 Burnett
1,963,593 A 6/1934 Prindle
2,007,002 A 7/1935 Porter
2,113,757 A 4/1938 Bietso et al.
2,349,608 A 5/1944 Bramble
2,430,495 A 11/1947 Dath
2,462,167 A 2/1949 Dath
2,661,030 A 12/1953 Crosby et al.
2,986,376 A 5/1961 Falck-Pedersen
3,028,885 A 4/1962 Leslie et al.
3,032,075 A 5/1962 Hall et al.
3,080,148 A 3/1963 Knoebel et al.
3,125,326 A 3/1964 Ericsson
3,194,541 A 7/1965 Kocian
3,206,167 A 9/1965 Armington
3,232,217 A 2/1966 Harmon et al.
3,284,049 A 11/1966 Haraden
3,309,061 A 3/1967 Plattner
3,329,178 A 7/1967 Plunkett
3,360,017 A 12/1967 Vilcins
3,367,374 A 2/1968 Meier et al.
3,442,733 A 5/1969 Vilcins
3,545,723 A 12/1970 Raley et al.
3,583,315 A 6/1971 Hebert
3,586,572 A 6/1971 Ericsson
3,654,033 A 4/1972 Angarola et al.
3,669,799 A 6/1972 Vilcins et al.
3,718,526 A 2/1973 Annis
3,740,087 A 6/1973 Back
3,783,079 A 1/1974 Wehr
3,792,808 A 2/1974 Neff et al.
3,799,835 A 3/1974 Gilmore
3,804,001 A 4/1974 Longerich et al.
3,844,317 A 10/1974 Angarola et al.
3,866,812 A 2/1975 Gutjahr
4,011,807 A 3/1977 Kobiella
4,015,643 A 4/1977 Cheung
4,020,879 A 5/1977 Billett et al.
4,050,372 A 9/1977 Kobiella
155,799 A 5/1979 Matsushita et al.
4,161,910 A 7/1979 Leslie et al.
4,177,724 A 12/1979 Johnson, III et al.
4,220,493 A 9/1980 Karl-Heinz et al.
4,239,096 A 12/1980 Smilgys et al.
4,240,865 A 12/1980 Kyts
4,252,158 A 2/1981 Mc Dade
4,253,227 A 3/1981 Bullington
4,254,703 A 3/1981 Fulton et al.
4,282,907 A 8/1981 Massion et al.
4,289,175 A 9/1981 Crittenden et al.
4,300,976 A 11/1981 Wehr
4,313,779 A 2/1982 Nix
4,328,742 A 5/1982 Discavage
4,398,572 A 8/1983 Fromm
4,444,097 A 4/1984 Wehr et al.
4,450,032 A 5/1984 Wehr
4,454,808 A 6/1984 Wehr et al.
4,483,516 A 11/1984 Wehr
4,488,926 A 12/1984 Rauch
4,502,911 A 3/1985 Discavage
4,535,730 A 8/1985 Allen
4,536,248 A 8/1985 Bullington et al.
4,559,767 A 12/1985 Takami
4,572,064 A 2/1986 Burton
4,575,994 A 3/1986 Takami
4,607,709 A 8/1986 Walser
4,625,500 A 12/1986 Huber
4,635,542 A 1/1987 Sebelist et al.
4,689,938 A 9/1987 Zoppa
4,707,390 A 11/1987 Cheung
4,718,219 A 1/1988 Schmitz
4,718,522 A 1/1988 Frania et al.
4,776,905 A 10/1988 Cheung et al.
4,820,363 A 4/1989 Fischer
4,850,179 A 7/1989 Takami
4,871,414 A 10/1989 Niedrig
4,901,775 A 2/1990 Scott et al.
4,934,261 A 6/1990 Niedrig
5,058,365 A 10/1991 Kagi
5,105,130 A 4/1992 Barker et al.
5,133,532 A 7/1992 Figiel et al.
5,141,591 A 8/1992 Boek et al.
5,146,847 A 9/1992 Lyon et al.
5,155,982 A 10/1992 Boek et al.
5,159,218 A 10/1992 Murry et al.
5,165,532 A 11/1992 Pipich et al.
5,379,576 A 1/1995 Koyama
5,509,594 A 4/1996 Maggioni
5,513,482 A 5/1996 Nagashima et al.
5,516,022 A 5/1996 Annis
5,518,043 A 5/1996 Cheung et al.
5,632,851 A 5/1997 Young
5,653,095 A 8/1997 Stamm
5,689,943 A 11/1997 Wehr
5,690,023 A 11/1997 Stamm et al.
5,694,984 A 12/1997 Cheung
5,798,596 A 8/1998 Lordo
5,809,873 A 9/1998 Chak et al.
5,831,404 A 11/1998 Ishii
5,853,524 A 12/1998 Nix
5,881,855 A 3/1999 Putney et al.
5,916,108 A 6/1999 Drietz et al.
5,942,061 A 8/1999 Figiel et al.
5,947,166 A 9/1999 Doyle et al.
5,954,899 A 9/1999 Figiel et al.
6,003,578 A 12/1999 Chang
6,041,581 A 3/2000 Huber
6,041,698 A 3/2000 Chin-Chang et al.
6,073,664 A 6/2000 Angarola
6,079,457 A 6/2000 Crittenden
6,109,325 A 8/2000 Chang
6,131,634 A 10/2000 Chang
6,173,747 B1 1/2001 Angarola et al.
6,206,053 B1 3/2001 Hillegonds
6,260,337 B1 7/2001 Cheung
6,308,745 B1 10/2001 Angarola et al.
6,308,760 B1 10/2001 Finzo et al.
6,328,087 B1 12/2001 Finzo et al.
6,332,306 B1 12/2001 Finzo et al.
6,332,386 B1 12/2001 Popp
6,338,375 B1 1/2002 Harada
6,345,658 B1 2/2002 Shida et al.
6,405,766 B1 6/2002 Benjey
6,405,776 B1 6/2002 Rauch
6,415,712 B1 7/2002 Helland et al.
6,422,272 B1 7/2002 Crittenden
6,463,721 B1 10/2002 Su et al.
6,463,847 B1 10/2002 Rauch
6,470,941 B1 10/2002 Wehr
6,516,715 B1 2/2003 Reiche
6,533,013 B1 3/2003 Nix
6,554,030 B2 4/2003 Cheung et al.
6,568,158 B2 5/2003 Shibazaki et al.
6,578,337 B2 6/2003 Scholl et al.
6,584,891 B1 7/2003 Smith et al.
6,606,766 B2 8/2003 Ko
6,640,838 B2 11/2003 Finzo
6,644,713 B2 11/2003 Del Pozo Abejon et al.
6,698,460 B2 3/2004 Marsche
6,715,375 B2 4/2004 Nestler
6,729,357 B2 5/2004 Marsche
6,732,638 B1 5/2004 Rometty et al.

(56) References Cited

U.S. PATENT DOCUMENTS 6,772,798 B2 8/2004 Cheung
6,817,159 B2 11/2004 Sakaki et al.
6,895,733 B2 5/2005 Nix
6,907,717 B2 6/2005 Nix
6,911,799 B2 6/2005 Jensen
6,918,235 B2 7/2005 Nix
6,957,678 B2 10/2005 Scholl et al.
6,966,255 B1 11/2005 Crittenden
6,971,567 B1 12/2005 Cannaliato et al.
7,011,000 B2 3/2006 Kushida et al.
7,017,323 B2 3/2006 Sobel
7,073,431 B1 7/2006 Chen
7,081,612 B1 7/2006 Lu
7,082,872 B2 8/2006 Goodley
7,089,970 B2 8/2006 Bernard
7,128,099 B2 10/2006 Finzo
7,155,885 B1 1/2007 Nasiatka et al.
7,157,882 B2 1/2007 Johnson et al.
7,204,187 B2 4/2007 Zeimetz et al.
7,236,243 B2 6/2007 Beecroft et al.
7,249,862 B2 7/2007 Shirane
7,312,609 B2 12/2007 Schmollngruber et al.
7,318,305 B2 1/2008 Reiche
7,350,543 B2 4/2008 Crittenden
7,377,213 B1 5/2008 Haberstroh et al.
7,428,866 B2 9/2008 Reiche
7,455,080 B2 11/2008 Crittenden et al.
7,456,608 B2 11/2008 Kageler et al.
7,497,068 B2 3/2009 Nasiatka et al.
7,556,129 B2 7/2009 Nix
7,562,620 B1 7/2009 Nasiatka et al.
7,637,208 B2 12/2009 Reiche et al.
7,669,526 B2 3/2010 Fay
7,703,330 B2 4/2010 Miyazaki et al.
D629,321 S 12/2010 Neeser et al.
7,857,560 B2 12/2010 Leggett et al.
7,900,524 B2 3/2011 Calloway et al.
7,948,336 B2 5/2011 Park
D651,498 S 1/2012 Neeser et al.
D653,923 S 2/2012 Neeser et al.
8,174,713 B2 5/2012 Yanagi et al.
8,198,839 B2 6/2012 Katou et al.
8,281,711 B2 10/2012 Haberstroh et al.
8,287,672 B2 10/2012 Neeser et al.
8,356,641 B2 1/2013 Marelin et al.
8,378,600 B2 2/2013 Katou et al.
8,387,523 B2 3/2013 Yang
8,567,310 B2 10/2013 Yi
8,967,217 B2 3/2015 Gardner et al.
9,085,070 B2 7/2015 Skonieczny et al.
9,132,928 B2 9/2015 Rooth
9,174,752 B2 11/2015 Neeser et al.
9,192,979 B2 11/2015 Itagaki
9,193,486 B2 11/2015 Neeser et al.
9,233,457 B2 1/2016 Wanek et al.
9,248,553 B2 2/2016 Schurder et al.
9,254,932 B2 2/2016 Neeser et al.
9,272,799 B2 3/2016 Figiel et al.
9,284,080 B2 3/2016 Neeser et al.
9,315,283 B2 4/2016 Neeser et al.
9,346,572 B2 5/2016 Leppert
9,387,573 B2 7/2016 Pearson
9,403,609 B2 8/2016 Bonifazi et al.
9,468,968 B2 10/2016 Figiel et al.
9,487,314 B2 11/2016 Finzo
9,586,708 B2 3/2017 Finzo
9,630,730 B2 4/2017 Leppert
9,789,984 B2 10/2017 Sikora et al.
9,932,135 B2 4/2018 Finzo et al.
9,938,029 B2 4/2018 Finzo et al.
9,994,341 B2 6/2018 Amacker et al.
10,058,989 B2 8/2018 Chellew
10,227,149 B2 3/2019 Keller
10,308,383 B2 6/2019 Boss et al.
10,336,002 B2 7/2019 Barlasov
10,370,132 B2 8/2019 Finzo et al.
10,464,699 B2 11/2019 Figiel et al.
10,518,914 B2 12/2019 Neeser et al.
10,577,137 B2 3/2020 Nasiatka et al.
10,604,286 B2 3/2020 Nelson
10,640,244 B2 5/2020 Widmer et al.
10,745,158 B2 8/2020 Sikora et al.
10,773,841 B2 9/2020 Skonieczny
10,882,649 B2 1/2021 Rauch
11,008,125 B2 5/2021 Kruzel
11,053,034 B1 7/2021 Sikora et al.
D928,577 S 8/2021 Hochstrasser
11,084,609 B2 8/2021 Hochstrasser et al.
11,084,610 B2 8/2021 Boss et al.
11,097,863 B2 8/2021 Figiel et al.
11,104,460 B2 8/2021 Neeser et al.
11,123,788 B2 9/2021 Kasahara et al.
11,130,598 B2 9/2021 Sikora et al.
11,155,375 B2 10/2021 Keller et al.
11,162,269 B2 11/2021 Machida et al.
11,174,051 B2 11/2021 Graef et al.
11,247,791 B2 2/2022 He et al.
11,247,792 B2 2/2022 Mellas et al.
11,267,596 B2 3/2022 Finzo et al.
11,377,241 B2 7/2022 Finzo
11,414,225 B2 8/2022 Brettschneider et al.
11,459,778 B2 10/2022 Nagaoka et al.
11,472,583 B2 10/2022 Finzo
11,473,322 B2 10/2022 Coles et al.
D969,883 S 11/2022 Hussy
11,485,528 B2 11/2022 Dohrmann et al.
11,492,157 B2 11/2022 Hochstrasser et al.
11,511,893 B2 11/2022 Sikora et al.
11,524,801 B2 12/2022 Keller et al.
11,530,059 B2 12/2022 Neeser et al.
11,560,245 B2 1/2023 Finzo et al.
11,560,246 B2 1/2023 Neeser et al.
11,560,247 B2 1/2023 Sikora et al.
11,571,733 B2 2/2023 Yoshida et al.
11,577,866 B2 2/2023 Nasiatka et al.
11,597,547 B2 3/2023 Finzo
11,667,417 B2 6/2023 Fizno et al.
11,667,418 B2 6/2023 Neeser et al.
11,731,794 B2 8/2023 Neeser et al.
11,760,515 B2 9/2023 Finzo et al.
11,932,430 B2 3/2024 Finzo et al.
11,981,464 B2 5/2024 Sikora et al.
2002/0100146 A1 8/2002 Ko
2002/0129717 A1 9/2002 Helland et al.
2002/0134811 A1 9/2002 Napier et al.
2002/0179174 A1 12/2002 Marsche
2002/0179175 A1 12/2002 Finzo
2003/0056337 A1 3/2003 Scholl et al.
2003/0121611 A1 7/2003 Scholl et al.
2003/0131570 A1 7/2003 Scholl et al.
2003/0145900 A1 8/2003 Jensen et al.
2003/0221566 A1 12/2003 Apel et al.
2003/0230058 A1 12/2003 Ni
2004/0050188 A1 3/2004 Richards et al.
2004/0206251 A1 10/2004 Nix
2004/0231289 A1 11/2004 Reiche
2004/0237467 A1 12/2004 Sobel
2005/0000586 A1 1/2005 Zeimetz et al.
2005/0279198 A1 12/2005 Kushida et al.
2006/0108180 A1 5/2006 Grach et al.
2006/0114498 A1 6/2006 Yanagi et al.
2006/0192527 A1 8/2006 Kageler et al.
2007/0227370 A1 10/2007 Reiche
2008/0196911 A1 8/2008 Krapf et al.
2008/0219745 A1 9/2008 Bungert et al.
2009/0013656 A1 1/2009 Nasiatka et al.
2009/0114308 A1 5/2009 Marelin et al.
2009/0266247 A1 10/2009 Reiche et al.
2010/0038397 A1 2/2010 Krondorfer et al.
2010/0077810 A1 4/2010 De Franceschi
2010/0242419 A1 9/2010 Dufeu et al.
2011/0056389 A1 3/2011 Neeser et al.
2011/0056390 A1 3/2011 Neeser et al.
2011/0056391 A1 3/2011 Neeser et al.

(56) References Cited

U.S. PATENT DOCUMENTS

| | | | |
|---|---|---|---|
| 2011/0056392 | A1 | 3/2011 | Neeser et al. |
| 2011/0100233 | A1 | 5/2011 | Neeser et al. |
| 2011/0253480 | A1 | 10/2011 | Goodman et al. |
| 2012/0007748 | A1 | 1/2012 | Forgues et al. |
| 2012/0017780 | A1 | 1/2012 | Haberstroh et al. |
| 2012/0160364 | A1 | 6/2012 | Katou et al. |
| 2012/0210682 | A1 | 8/2012 | Gardner et al. |
| 2012/0299727 | A1 | 11/2012 | Newman et al. |
| 2013/0092408 | A1 | 4/2013 | Oberheim |
| 2013/0186287 | A1 | 7/2013 | Vick et al. |
| 2014/0008090 | A1 | 1/2014 | Kokinelis et al. |
| 2014/0060345 | A1 | 3/2014 | Figiel et al. |
| 2014/0083311 | A1 | 3/2014 | Bonifazi et al. |
| 2014/0290179 | A1 | 10/2014 | Keller |
| 2014/0311363 | A1 | 10/2014 | Leppert |
| 2015/0033959 | A1 | 2/2015 | Finzo |
| 2015/0034206 | A1 | 2/2015 | Finzo |
| 2015/0210411 | A1 | 7/2015 | Finzo et al. |
| 2015/0246739 | A1 | 9/2015 | Finzo et al. |
| 2016/0046398 | A1 | 2/2016 | Neeser et al. |
| 2016/0068287 | A1 | 3/2016 | Gannon |
| 2016/0107775 | A1 | 4/2016 | Amacker et al. |
| 2016/0107776 | A1 | 4/2016 | Amacker et al. |
| 2016/0137323 | A1 | 5/2016 | Amacker |
| 2016/0159505 | A1 | 6/2016 | Widmer et al. |
| 2016/0376041 | A1 | 12/2016 | Skonieczny et al. |
| 2017/0008652 | A1 | 1/2017 | Figiel et al. |
| 2017/0152065 | A1 | 6/2017 | Ballard |
| 2017/0166335 | A1 | 6/2017 | Nasiatka et al. |
| 2017/0174374 | A1 | 6/2017 | Figiel et al. |
| 2018/0054033 | A1 | 2/2018 | Skonieczny et al. |
| 2018/0250805 | A1 | 9/2018 | Takidis et al. |
| 2019/0168900 | A1 | 6/2019 | Keller |
| 2020/0156224 | A1 | 5/2020 | Suenaga |
| 2020/0339289 | A1 | 10/2020 | Finzo |
| 2020/0339290 | A1 | 10/2020 | Finzo |
| 2020/0369415 | A1 | 11/2020 | Skonieczny |
| 2020/0377245 | A1 | 12/2020 | Sikora et al. |
| 2021/0016907 | A1 | 1/2021 | Sikora et al. |
| 2021/0221543 | A1 | 7/2021 | Finzo |
| 2021/0309400 | A1 | 10/2021 | Yu |
| 2021/0371142 | A1 | 12/2021 | Figiel et al. |
| 2022/0009659 | A1 | 1/2022 | Sikora et al. |
| 2022/0048656 | A1 | 2/2022 | Graef et al. |
| 2022/0063850 | A1 | 3/2022 | Keller et al. |
| 2022/0119140 | A1 | 4/2022 | Sikora et al. |
| 2022/0144463 | A1 | 5/2022 | Finzo et al. |
| 2022/0227508 | A1 | 7/2022 | Jang et al. |
| 2022/0227509 | A1 | 7/2022 | Jang et al. |
| 2022/0297861 | A1 | 9/2022 | Diederiks et al. |

FOREIGN PATENT DOCUMENTS

| | | | |
|---|---|---|---|
| BE | 893127 | A | 8/1982 |
| BE | 893128 | A | 8/1982 |
| CA | 499861 | A | 2/1954 |
| CA | 2432353 | A1 | 12/2003 |
| CA | 2543819 | C | 12/2003 |
| CH | 303489 | A | 11/1954 |
| CH | 372241 | A | 9/1963 |
| CH | 378223 | A | 5/1964 |
| CH | 705743 | A2 | 5/2013 |
| CH | 705744 | A2 | 5/2013 |
| CH | 705745 | A2 | 5/2013 |
| CH | 708328 | A2 | 12/2014 |
| CH | 708330 | A2 | 12/2014 |
| CH | 708331 | A2 | 12/2014 |
| CH | 708332 | A2 | 12/2014 |
| CH | 709244 | A2 | 8/2015 |
| CH | 709245 | A2 | 8/2015 |
| CH | 709246 | A2 | 8/2015 |
| CN | 1055426 | C | 10/1991 |
| CN | 2266566 | Y | 11/1997 |
| CN | 2346694 | Y | 11/1999 |
| CN | 1253098 | A | 5/2000 |
| CN | 1297270 | A | 5/2001 |
| CN | 1386675 | A | 12/2002 |
| CN | 1386676 | A | 12/2002 |
| CN | 1660675 | A | 8/2005 |
| CN | 101164416 | A | 4/2008 |
| CN | 101267988 | A | 9/2008 |
| CN | 100460284 | C | 2/2009 |
| CN | 101422761 | A | 5/2009 |
| CN | 101486329 | A | 7/2009 |
| CN | 101585244 | A | 11/2009 |
| CN | 201411059 | Y | 2/2010 |
| CN | 101870367 | A | 10/2010 |
| CN | 201957492 | U | 9/2011 |
| CN | 202100012 | U | 1/2012 |
| CN | 105358432 | A | 2/2016 |
| CN | 209258454 | U | 8/2019 |
| CN | 209258455 | U | 8/2019 |
| CN | 209258456 | U | 8/2019 |
| CN | 209258457 | U | 8/2019 |
| CN | 209258462 | U | 8/2019 |
| CN | 209366535 | U | 9/2019 |
| CN | 209366545 | U | 9/2019 |
| CN | 209410408 | U | 9/2019 |
| CN | 209410410 | U | 9/2019 |
| CN | 111762397 | A | 10/2020 |
| CN | 111776283 | A | 10/2020 |
| CN | 111776284 | A | 10/2020 |
| CN | 111776285 | A | 10/2020 |
| CN | 212401669 | U | 1/2021 |
| CN | 212401670 | U | 1/2021 |
| CN | 212474062 | U | 2/2021 |
| CN | 212606304 | U | 2/2021 |
| CN | 212767210 | U | 3/2021 |
| CN | 214002141 | U | 8/2021 |
| CN | 214566362 | U | 11/2021 |
| CN | 114013712 | A | 2/2022 |
| CN | 114148567 | A | 3/2022 |
| CN | 114229081 | A | 3/2022 |
| CN | 114229082 | A | 3/2022 |
| CN | 114261562 | A | 4/2022 |
| CN | 216301573 | U | 4/2022 |
| CN | 216301575 | U | 4/2022 |
| CN | 114476180 | A | 5/2022 |
| CN | 216468689 | U | 5/2022 |
| CN | 216611733 | U | 5/2022 |
| CN | 114572447 | A | 6/2022 |
| CN | 216734903 | U | 6/2022 |
| CN | 216834406 | U | 6/2022 |
| CN | 216834408 | U | 6/2022 |
| CN | 216834409 | U | 6/2022 |
| CN | 216916412 | U | 7/2022 |
| CN | 217100581 | U | 8/2022 |
| CN | 217375001 | U | 9/2022 |
| CN | 217375005 | U | 9/2022 |
| CN | 218641139 | U | 3/2023 |
| CN | 116692100 | A | 9/2023 |
| DE | 675534 | C1 | 5/1939 |
| DE | 709965 | C1 | 8/1941 |
| DE | 811815 | C1 | 8/1951 |
| DE | 822677 | C1 | 11/1951 |
| DE | 822678 | C1 | 11/1951 |
| DE | 829271 | C1 | 1/1952 |
| DE | 893772 | C1 | 10/1953 |
| DE | 936257 | C1 | 12/1955 |
| DE | 936496 | C1 | 12/1955 |
| DE | 937515 | C | 1/1956 |
| DE | 947239 | C1 | 8/1956 |
| DE | 10 08 644 | B | 5/1957 |
| DE | 10 65 321 | B | 9/1959 |
| DE | 11 12 448 | B | 8/1961 |
| DE | 11 40 858 | B | 12/1962 |
| DE | 18 93 046 | U | 5/1964 |
| DE | 11 73 017 | B | 6/1964 |
| DE | 11 85 532 | B | 1/1965 |
| DE | 12 11 102 | B | 2/1966 |
| DE | 12 15 577 | B | 4/1966 |
| DE | 19 73 947 | U | 11/1967 |
| DE | 12 78 337 | B | 9/1968 |
| DE | 15 11 982 | A1 | 11/1969 |

(56) References Cited

FOREIGN PATENT DOCUMENTS

| | | | |
|---|---|---|---|
| DE | 15 86 001 | A1 | 4/1970 |
| DE | 15 86 002 | A1 | 4/1970 |
| DE | 15 86 553 | A1 | 6/1970 |
| DE | 15 86 549 | A1 | 8/1970 |
| DE | 15 86 550 | A1 | 8/1970 |
| DE | 18 06 370 | B2 | 1/1971 |
| DE | 23 35 805 | A1 | 2/1974 |
| DE | 22 49 500 | A1 | 4/1974 |
| DE | 22 49 522 | A1 | 4/1974 |
| DE | 23 02 912 | A1 | 7/1974 |
| DE | 24 31 153 | A1 | 1/1976 |
| DE | 24 43 642 | A1 | 3/1976 |
| DE | 21 02 344 | C3 | 5/1977 |
| DE | 26 41 889 | A1 | 3/1978 |
| DE | 27 23 312 | A1 | 12/1978 |
| DE | 27 31 165 | A1 | 1/1979 |
| DE | 27 35 511 | A1 | 2/1979 |
| DE | 32 29 870 | A1 | 2/1984 |
| DE | 198516414 | U1 | 9/1985 |
| DE | 36 09 354 | A1 | 10/1986 |
| DE | 35 25 647 | A1 | 1/1987 |
| DE | 198113906 | U1 | 1/1988 |
| DE | 198113907 | U1 | 2/1988 |
| DE | 198129880 | U1 | 4/1988 |
| DE | 38 20 060 | A1 | 12/1989 |
| DE | 199000418 | U1 | 1/1990 |
| DE | 40 14 305 | A1 | 11/1991 |
| DE | 42 04 420 | A1 | 8/1993 |
| DE | 199306786 | U1 | 8/1993 |
| DE | 199311406 | U1 | 11/1993 |
| DE | 199319249 | U1 | 2/1994 |
| DE | 29517428 | U1 | 2/1996 |
| DE | 29722491 | U1 | 4/1998 |
| DE | 19751861 | A1 | 1/1999 |
| DE | 19816970 | A1 | 10/1999 |
| DE | 10026200 | A1 | 11/2001 |
| DE | 10134255 | B4 | 2/2003 |
| DE | 19823400 | B4 | 7/2004 |
| DE | 10 2004 012 732 | B3 | 12/2004 |
| DE | 20 2005 007 849 | U1 | 9/2005 |
| DE | 10 2005 049 130 | A1 | 4/2007 |
| DE | 10 2006 007 990 | A1 | 8/2007 |
| DE | 10 2010 016 774 | B4 | 11/2011 |
| DE | 20 2011 050 797 | U1 | 11/2011 |
| DE | 10 2011 121 432 | A1 | 6/2013 |
| DE | 20 2016 102 880 | U1 | 9/2017 |
| DK | 199200100 | U4 | 11/1992 |
| EP | 0 769 08 | B1 | 4/1983 |
| EP | 0 956 43 | A2 | 12/1983 |
| EP | 0 279 871 | A1 | 8/1988 |
| EP | 0 465 772 | B1 | 1/1992 |
| EP | 0 603 868 | A1 | 6/1994 |
| EP | 0 659 525 | A2 | 6/1995 |
| EP | 0 662 438 | A1 | 7/1995 |
| EP | 0 664 256 | A1 | 7/1995 |
| EP | 0 703 146 | A1 | 3/1996 |
| EP | 0 744 343 | A1 | 11/1996 |
| EP | 0 730 920 | B1 | 11/2001 |
| EP | 1 177 978 | A1 | 2/2002 |
| EP | 1 260 441 | A1 | 11/2002 |
| EP | 1 413 519 | B | 3/2007 |
| EP | 2 206 650 | A1 | 7/2010 |
| EP | 2 271 553 | A1 | 1/2011 |
| EP | 2 711 301 | B1 | 3/2014 |
| EP | 2 865 601 | A1 | 4/2015 |
| EP | 2 897 866 | A1 | 7/2015 |
| EP | 3 272 659 | A1 | 1/2018 |
| EP | 3 696 103 | A | 8/2020 |
| EP | 3 892 552 | B1 | 10/2021 |
| EP | 4 316 995 | A1 | 2/2024 |
| FI | 47064 | C | 9/1973 |
| FI | 47065 | C | 9/1973 |
| FI | 47066 | C | 9/1973 |
| FI | 47469 | C | 12/1973 |
| FI | 47555 | C | 1/1974 |
| FR | 1114726 | A | 4/1956 |
| FR | 1287960 | A | 3/1962 |
| FR | 1308538 | A | 11/1962 |
| GB | 0 405 753 | A | 2/1934 |
| GB | 0 713 474 | A | 8/1954 |
| GB | 0 785 407 | A | 10/1957 |
| GB | 0 956 978 | A | 4/1964 |
| GB | 1 048 598 | A | 11/1966 |
| GB | 1 161 827 | A | 8/1969 |
| GB | 2 041 869 | A | 9/1980 |
| GB | 1 984 01818 | | 2/1984 |
| GB | 2 088 466 | B | 8/1984 |
| GB | 2 098 163 | B | 9/1985 |
| GB | 2 144 075 | B | 11/1986 |
| GB | 2 185 228 | A | 7/1987 |
| GB | 2 185 229 | A | 7/1987 |
| GB | 2 144 092 | B | 5/1988 |
| GB | 2 179 623 | B | 5/1988 |
| GB | 2 191 987 | B | 5/1988 |
| GB | 2 481 724 | A | 1/2012 |
| ID | 501009 | A | 4/2010 |
| IT | 2019000006286 | B1 | 3/2021 |
| IT | 2019000006288 | B1 | 3/2021 |
| IT | 2020000027110 | B1 | 12/2022 |
| IT | 202200002321 | A1 | 8/2023 |
| JP | 54-001238 | B | 1/1979 |
| JP | 56-038220 | A | 4/1981 |
| JP | 57-027852 | A | 2/1982 |
| JP | S646555 | A | 1/1989 |
| JP | 03-054566 | U | 3/1991 |
| JP | 07-300108 | A | 11/1995 |
| JP | 08-258808 | A | 10/1996 |
| JP | 09-283103 | A | 10/1997 |
| JP | H1110259 | A | 1/1999 |
| JP | 3044132 | B2 | 5/2000 |
| JP | 2003-231291 | A | 8/2003 |
| JP | 2003-534989 | A | 11/2003 |
| JP | 2003-348899 | A | 12/2003 |
| JP | 2004-018117 | A | 1/2004 |
| JP | 2004-108593 | A | 4/2004 |
| JP | 2004-241150 | A | 8/2004 |
| JP | 2011-518085 | A | 6/2011 |
| JP | 2011-518088 | A | 6/2011 |
| KR | 20020013056 | A | 2/2002 |
| KR | 100346511 | B1 | 7/2002 |
| KR | 100943256 | B1 | 2/2010 |
| KR | 101613251 | B1 | 4/2016 |
| MY | 2008PI000630 | | 3/2008 |
| RU | 1772784 | C | 10/1992 |
| RU | 2161773 | C2 | 1/2001 |
| RU | 2355821 | C1 | 5/2009 |
| SE | 356270 | B | 5/1973 |
| SE | 373328 | B | 2/1975 |
| SE | 389320 | B | 11/1976 |
| SE | 395873 | B | 8/1977 |
| SE | 464630 | B | 5/1991 |
| TW | 1276571 | B | 3/2007 |
| WO | WO-84/00023 | A1 | 1/1984 |
| WO | WO-95/13966 | A1 | 5/1995 |
| WO | WO-00/03864 | A1 | 1/2000 |
| WO | WO-00/56606 | A1 | 9/2000 |
| WO | WO-01/89929 | A1 | 11/2001 |
| WO | WO-2006/048738 | A1 | 5/2006 |
| WO | WO-2007/033775 | A1 | 3/2007 |
| WO | WO-2008/128661 | A1 | 10/2008 |
| WO | WO-2009/062612 | A2 | 5/2009 |
| WO | WO-2009/114717 | A2 | 9/2009 |
| WO | WO-2009/129633 | A1 | 10/2009 |
| WO | WO-2009/129634 | A1 | 10/2009 |
| WO | WO-2009/129636 | A1 | 10/2009 |
| WO | WO-2010/029451 | A1 | 3/2010 |
| WO | WO-2013/091869 | A1 | 6/2013 |
| WO | WO-2013/181772 | A1 | 12/2013 |
| WO | WO-2014/072775 | A1 | 5/2014 |
| WO | WO-2014/167377 | A1 | 10/2014 |
| WO | WO-2014/194434 | A1 | 12/2014 |
| WO | WO-2015/089538 | A1 | 6/2015 |
| WO | WO-2015/089539 | A1 | 6/2015 |
| WO | WO-2015/1089539 | | 6/2015 |

(56) References Cited

FOREIGN PATENT DOCUMENTS

| | | | |
|---|---|---|---|
| WO | WO-2015/162171 | A1 | 10/2015 |
| WO | WO-2017/112002 | A1 | 6/2017 |
| WO | WO-2018/140868 | A1 | 8/2018 |
| WO | WO-2022/015566 | A2 | 1/2022 |
| WO | WO-2023/004232 | A2 | 1/2023 |
| WO | WO-2024/003765 | A1 | 1/2024 |
| WO | WO-2024/003772 | A1 | 1/2024 |
| WO | WO-2024/003852 | A1 | 1/2024 |

OTHER PUBLICATIONS

"Technical Data Sheet" BXT3-13/BXT3-16/ BXT3-19, published in Apr. 2017 (2 pages).
"The Cyklop CB 130 The trend-setting dimension in singlehanded strapping" by Cyklop International, published 2004. (4 pages).
A document showing several figures of the purchased "Cyklop CB 130" tool (9 pages).
A document showing several figures of the purchased "Fromm P331" tool (14 pages).
A picture evidencing year of manufacture of 2004 of the purchased "Cyklop CB 130" tool (1 page).
Allstrap Operation, Parts, and Safety Manual, SIGNODE BXT2-19 Battery-Hand Tool for Plastic Strapping, pp. 1-36, dated Sep. 2009 (36 pages).
Allstrap SIGNODE BXT2-19 Battery Powered Strapping Tool, Website https://web.archive.org/web/20170711184625/https://www.allstrap.com/poly-battery-tools/BXT219, pp. 1-14 (14 pages).
An EC-Declaration of Conformity according to the "EC Guidelines 98/37 EC Part 2A for machines of interconnected machinery" signed by the Head of Marketing of Cyklop GmbH on Mar. 7, 2002, delivered with the purchase "Cyklop CB 130" tool (1 page).
An invoice regarding the purchase of the "Cyklop CB 130" tool from a distributor dated Sep. 6, 2022 (1 page).
Auszug aus dem Fachbuch ?Sensoren? (K. Karvinen, T. Karvinen (3 pages).
Auszug aus der Internet Archive Wayback Machine (36 pages).
Auszug aus der Internet Archive Wayback Machine vom 12, Apr. 2008 (1 page).
Auszug aus der Internet Archive Wayback Machine vom 27, Jan. 2004 (1 page).
Auszug aus der Internet Archive Wayback Machine vom 4. Juni E (1 page).
Auszug aus der Internet Archive Wayback Machine vom 6 (1 page).
Auszuge aus einem Angebot vom Dezember 2017 der Seite E (1 page).
Bedienungsanleitung des Umreifungsgerates OR-T 250 (1 page).
Bedienungsanleitung des Umreifungsgerats Cyklop CB 130 (22 pages).
BENDER—"Lithium ion technology: Shaping Power Tools" Air Conditioning, Heating, and Refrigeration News. vol. 228, Issue 14, p. 18 Jul. 31, 2006 (4 pages).
Broschure des Umreifungsgerats Cyklop CB 130 (2 pages).
BXT 2 Maintenance Manual, https://usastrap.com/wp-content/uploads/Signode_BXT2_Maintenance-Manual_Battery_Hand_Tool.pdf, dated Mar. 2011 (33 pages).
BXT2 Video, https://www.youtube.com/watch?v=tCNwXuKICWQ, published on YouTube by user jgipperich on Jun. 26, 2012. (1 page).
BXT2-16 Battery Powered Combination Tool for Polyester Strapping, published on Signode Corporate Website on Jan. 4, 2011. Located via Google. (1 page).
BXT2-19 Battery Powered Combination Tool for Polyester Strapping, published on Signode Corporate Website on Nov. 19, 2009 (1 page).
BXT2-19 Battery Powered Combination Tool for Polyester Strapping, published on Signode Corporate Website on Nov. 19, 2009. Located via Google. (1 page).
BXT2-25/32 Battery Powered Combination Tool for Polyester Strapping (Heavy-duty design for 1" and 1-1/4" polyester strapping applications), published on Signode Corporate Website on Jan. 4, 2011. Located via Google. (1 page).
Cyklop CMT 50—CMT Operating and Safety Instructions from serie No. 50/72611 "Hand tool for plastic strapping" dated Dec. 12, 2006, pp. 1-53. (53 pages).
Cyklop International—CB 130 "CB 130 Battery/Friction Weld Handtool" Product publication released by CYKLOP (Accessed via Wayback Machine: https://web.archive.org/web/20080607044652/http://cyklop.co.uk:80/product.asp?id=141) Accessed Mar. 28, 2024 (2 pages).
Cyklop International—CB 130 "Hand Tool for PP/PET-strapping," Operating Manual, Traditional Tool Repair Inc., dated Jan. 17, 2005. (22 pages).
Cyklop International—CB 130 "Handapparat / Hand Tool CB 130" Operating Instructions and Operating Sequence, dated Apr. 2004. (26 pages).
Cyklop International—CB 130 "Handapparat / Hand Tool CB 130" Operating Instructions, dated Apr. 2004. (22 pages).
Cyklop International—CB 130 "The Cyklop CB 130, the new dimension in single-handed strapping" Marketing Brochure (2 pages).
Cyklop International—CB 130 "The Cyklop CB 130, The new dimension in single-handed strapping" Product Brochure, dated Jan. 4, 2003 (2 pages).
Cyklop International—CB 130 Hand tool for PP/PET—Strapping; Traditional Tool Repair, Inc. dated Mar. 7, 2022; (22 pages).
Cyklop International—CB 130 Operating Sequence, dated Sep. 2003. (4 pages).
Cyklop International—CB-130 "CB130 Battery Powered Friction Weld Tool" Brochure, Published by CYKLOP May 2006 (1 page).
Cyklop International—CB-130 "Friction Weld-Battery Powered—CB 130" Manual and Spare Parts List, Sep. 2005 (9 pages).
Cyklop International—CE 92/CLT 100/CHT 400 "Cyklop Plastic Strapping Hand Tools" Marketing Brochure, CYKLOP International, dated 2009. (6 pages).
Cyklop International—CH 47 "Strapping Hand Tool CH 47" Product Brochure, document created Oct. 25, 2002 (2 pages).
Cyklop International—CHT 300 "Battery-hand tool for plastic strapping" Operating Manual, Traditional Tool Repair Inc., dated Dec. 2007. (53 pages).
Cyklop International—CHT 400 "Spare Parts List" dated Sep. 2009 (6 pages).
Cyklop International—CL 100 "The Cyklop CL 100, The innovation in load strapping" Product Brochure, dated 2003 (2 pages).
Cyklop International—CMT 200 "Battery-hand tool for plastic strapping" Operating Manual, Traditional Tool Repair Inc., dated Jan. 2008. (53 pages).
Cyklop International—CMT 250/CHT 400 "Cyklop CMT 250 / CHT 400 for medium-weight and heavy packages" Brochure Published by CYKLOP 2009 (2 pages).
Cyklop International—CMT 250/CHT 400 "Plastic Strapping Hand Tool Model Series: CMT 250 / CHT 400" Brochure Published by CYKLOP Mar. 2012 (2 pages).
Cyklop International—CMT 260 "CLT 130/CMT 260/CHT450 Battery-hand tool for plastic strapping" Operating Manual, Traditional Tool Repair Inc., dated Mar. 2017. (28 pages).
Cyklop International—CMT 50 "Hand tool for plastic strapping" Operating Manual, CYKLOP International, dated Feb. 2008, (53 pages).
Cyklop International—CP 500 "Hand Tool for PP/PET-strapping" Operating Manual, Traditional Tool Repair Inc., dated Jun. 2009. (28 pages).
Cyklop International—CP 98 "Pneumatic Strapping Tool CP 98" Product Brochure, document created Jan. 3, 2003 (2 pages).
Cyklop International—CR 19 "CR 19 Battery-Driven Steel Strapping Tool" Product Brochure, dated 2024 (2 pages).
Cyklop International—PN 6.1 "Steel Strap—Strapping Tools" Marketing Brochure, CYKLOP International, dated 2009. (2 pages).
Cyklop International CB 130 Hand Tool for PP/PET Strapping; Service for internal use only, pp. 1-36 dated Aug. 5, 2022 (36 pages).
Cyklop International CB 130 Hand Tool for PP/PET Strapping; Service for internal use only, pp. 1-39, dated Aug. 2002 (39 pages).

(56) References Cited

OTHER PUBLICATIONS

Cyklop International, "Cyklop completes its hand tool range with new CP500 pneumatic strapper" Warehouse & Logistics News, dated Sep. 30, 2008 (2 pages).
Cyklop International-CMT 250 "Battery-hand tool for plastic strapping" dated Sep. 4, 2009, pp. 1-36 (36 pages).
CYKLOP International—CP 500 "Strapping hand tool CP500 Pneumatic Hand Tool" dated Sep. 1, 2008, pp. 1-2 (2 pages).
Declaration of Detlef Scholl Sep. 7, 22 (10 pages).
Declaration of Glenn E. Vallee Sep. 7, 22 (235 pages).
Emandi—"Brushless DC Motor Drives" Energy-Efficient Electrical Motors, 3rd ed., Aug. 2004, 1. 270-272, CRC Press & Marcel Dekker (4 pages).
European Search Report for EP Application No. 20157484.5, dated Jun. 12, 2020. (9 pages).
First screenshot of a Website1 (Wayback Machine used) dated Jul. 3, 2010, evidencing that the "Cyklop CB 130" tool could be routinely purchased (1 page).
Fotoaufnahmen der CB 130 (2 pages).
Fromm Operation Manual/Spare Parts List for Battery-Powered Plastic Strapping Tool for Model P331 M/HA distributed by Allstrap on Jun. 3, 2014 (26 pages).
Fromm Operation Manual/Spare Parts List for Battery-Powered Strapping Tool for Model P331 M/HA distributed by Allstrap on Oct. 1, 2014, pp. 1-26 (26 pages).
Fromm Operation Manual/Spare Parts List, "Battery-Powered Plastic Strapping Tool Model P328 M/HA 43.2462.01," dated Jan. 2015 (26 pages).
Fromm Operations Manual/Spare Parts list "Battery—Powered Plastic Strapping Tool Model P324 43.0662.01," dated Nov. 14, 2008 (26 pages).
Fromm Operations Manual/Spare Parts list "Battery—Powered Plastic Strapping Tool Model P325 43.0733.01," Distributed by Allstrap, Mar. 2007 (26 pages).
Fromm Operations Manual/Spare Parts list "Pneumatic Plastic Strapping Tool Model P350 Semi—Automatic 49.4211.02," Distributed by Allstrap, on Sep. 12, 2014 (28 pages).
Fromm Operations Manual/Spare Parts List 49.4211.02, pp. 15-27 (13 pages).
Fromm Operations Manual/Spare Parts List for Battery-Powered Plastic Strapping Tool Model P320, 43.0324.02, dated Apr. 1999 (10 pages).
Fromm Operations Manual/Spare Parts List for Battery-Powered Plastic Strapping Tool Model P320, 43.0562.04, dated Apr. 2005 (20 pages).
Fromm Operations Manual/Spare Parts List for Battery-Powered Plastic Strapping Tool Model P330, 43.0264.01, pp. 1-26, dated May 2009 (26 pages).
Fromm Operations Manual/Spare Parts, Traditional Tool, https://traditionaltool.com/content/ttr_specs_docs/MANUALS/Fromm%20Manuals/13.4210%20%20A452%20v1.pdf, dated Mar. 27, 2001 (16 pages).
Fromm Service Manual, "Battery-Powered Plastic Strapping Tool Model P324.0001.01" dated Dec. 2008 (54 pages).
Fromm Service Manual, "Battery-Powered Plastic Strapping Tool Model P325.0001.01" dated Dec. 2008 (52 pages).
Fromm Service Manual, "Battery-Powered Plastic Strapping Tool Model P328 M/HA / P328 A/A" dated Feb. 2016 (47 pages).
Fromm Service Manual, "Battery-Powered Plastic Strapping Tool Model P331 M/HA / P331 A/A" dated Jun. 2016 (48 pages).
Fromm Spare Parts List for P350 (13 pages).
Greenbridge—Evolution LT, Operation Manual/Spare Parts List, "Battery Powered Plastic Strapping Tool," Greenbridge, dated Apr. 2021 (40 pages).
Greenbridge, Introducing the Evolution LT Fully Automatic, Battery Powered Smart Strapping Tool, www.greenbridge.com, Aug. 2021, pp. 1-2. (2 pages).
Internal Service Manual English CB 130 Hand Tool (39 pages).
Internal Service Manual German CB 130 Hand Tool (39 pages).
Invalidity Contentions served on Jul. 10, 2024 in *Signode Industrial Group LLC* v. *Samuel, Son & Co., Ltd. et al* (E.D. Tex. 2:24-cv-00080-JRG) Exhibit A01—U.S. Patent Application Pub. No. US 2011/0056391 A1 ("Neeser") vs. Asserted Claims of U.S. Pat. No. 11,667,417 (97 pages).
Invalidity Contentions served on Jul. 10, 2024 in *Signode Industrial Group LLC* v. *Samuel, Son & Co., Ltd. et al* (E.D. Tex. 2:24-cv-00080-JRG) Exhibit A02—U.S. Pat. No. 5,653,095 ("Stamm") vs. Asserted Claims of U.S. Pat. No. 11,667,417 (57 pages).
Invalidity Contentions served on Jul. 10, 2024 in *Signode Industrial Group LLC* v. *Samuel, Son & Co., Ltd. et al* (E.D. Tex. 2:24-cv-00080-JRG) Exhibit A03—U.S. Patent Application Pub. No. US 2012/0210682A1 ("Gardner") vs. Asserted Claims of U.S. Pat. No. 11,667,417 (65 pages).
Invalidity Contentions served on Jul. 10, 2024 in *Signode Industrial Group LLC* v. *Samuel, Son & Co., Ltd. et al* (E.D. Tex. 2:24-cv-00080-JRG) Exhibit A04—U.S. Pat. No. 4,313,779 ("Nix") vs. Asserted Claims of U.S. Pat. No. 11,667,417 (55 pages).
Invalidity Contentions served on Jul. 10, 2024 in *Signode Industrial Group LLC* v. *Samuel, Son & Co., Ltd. et al* (E.D. Tex. 2:24-cv-00080-JRG) Exhibit A05—U.S. Pat. No. 3,032,075 ("Hall") vs. Asserted Claims of U.S. Pat. No. 11,667,417 (44 pages).
Invalidity Contentions served on Jul. 10, 2024 in *Signode Industrial Group LLC* v. *Samuel, Son & Co., Ltd. et al* (E.D. Tex. 2:24-cv-00080-JRG) Exhibit A06—U.S. Pat. No. 6,578,337 ("Scholl") vs. Asserted Claims of U.S. Pat. No. 11,667,417 (51 pages).
Invalidity Contentions served on Jul. 10, 2024 in *Signode Industrial Group LLC* v. *Samuel, Son & Co., Ltd. et al* (E.D. Tex. 2:24-cv-00080-JRG) Exhibit A07—U.S. Pat. No. 6,328,087 ("Finzo") vs. Asserted Claims of U.S. Pat. No. 11,667,417 (63 pages).
Invalidity Contentions served on Jul. 10, 2024 in *Signode Industrial Group LLC* v. *Samuel, Son & Co., Ltd. et al* (E.D. Tex. 2:24-cv-00080-JRG) Exhibit A08—U.S. Pat. No. 7,073,431 ("Chen") vs. Asserted Claims of U.S. Pat. No. 11,667,417 (52 pages).
Invalidity Contentions served on Jul. 10, 2024 in *Signode Industrial Group LLC* v. *Samuel, Son & Co., Ltd. et al* (E.D. Tex. 2:24-cv-00080-JRG) Exhibit A09—U.S. Pat. No. 9,403,609 ("Bonifazi") vs. Asserted Claims of U.S. Pat. No. 11,667,417 (63 pages).
Invalidity Contentions served on Jul. 10, 2024 in *Signode Industrial Group LLC* v. *Samuel, Son & Co., Ltd. et al* (E.D. Tex. 2:24-cv-00080-JRG) Exhibit A10—U.S. Pat. No. 6,895,733 ("Nix (733)") vs. Asserted Claims of U.S. Pat. No. 11,667,417 (40 pages).
Invalidity Contentions served on Jul. 10, 2024 in *Signode Industrial Group LLC* v. *Samuel, Son & Co., Ltd. et al* (E.D. Tex. 2:24-cv-00080-JRG) Exhibit A11—for U.S. Patent Application Pub. No. US2016/0107775 ("Amacker") vs. Asserted Claims of U.S. Pat. No. 11,667,417 (105 pages).
Invalidity Contentions served on Jul. 10, 2024 in *Signode Industrial Group LLC* v. *Samuel, Son & Co., Ltd. et al* (E.D. Tex. 2:24-cv-00080-JRG) Exhibit A12—U.S. Pat. No. 4,488,926 ("Rauch") vs. Asserted Claims of U.S. Pat. No. 11,667,417 (49 pages).
Invalidity Contentions served on Jul. 10, 2024 in *Signode Industrial Group LLC* v. *Samuel, Son & Co., Ltd. et al* (E.D. Tex. 2:24-cv-00080-JRG) Exhibit A13—Cyklop CB 130 ("CB 130") vs. Asserted Claims of U.S. Pat. No. 11,667,417 (63 pages).
Invalidity Contentions served on Jul. 10, 2024 in *Signode Industrial Group LLC* v. *Samuel, Son & Co., Ltd. et al* (E.D. Tex. 2:24-cv-00080-JRG) Exhibit A14—U.S. Patent Application Pub. No. US 2011/0056392 A1 ("Neeser II") vs. Asserted Claims of U.S. Pat. No. 11,667,417 (77 pages).
Invalidity Contentions served on Jul. 10, 2024 in *Signode Industrial Group LLC* v. *Samuel, Son & Co., Ltd. et al* (E.D. Tex. 2:24-cv-00080-JRG) Exhibit A15—Secondary References to be Used in Combination With Other References for U.S. Pat. No. 2,936,156 ("Coupland") European Patent EP1008520B1 ("Harada") U.S. Pat. No. 4,015,643 ("Cheung") vs. Asserted Claims of U.S. Pat. No. 11,667,417 (43 pages).
Invalidity Contentions served on Jul. 10, 2024 in *Signode Industrial Group LLC* v. *Samuel, Son & Co., Ltd. et al* (E.D. Tex. 2:24-cv-00080-JRG) Exhibit B01—U.S. Pat. No. 6,328,087 ("Finzo 087") vs. Asserted Claims of the '418 Patent (243 pages).
Invalidity Contentions served on Jul. 10, 2024 in *Signode Industrial Group LLC* v. *Samuel, Son & Co., Ltd. et al* (E.D. Tex. 2:24-cv-

(56) References Cited

OTHER PUBLICATIONS

00080-JRG) Exhibit B02—"FROMM Operation Manual / Spare Parts List Battery-Powered Plastic Strapping Tool Model P331 M/HA" ("Fromm P331 Manual") vs. Asserted Claims of the '418 Patent (118 pages).
Invalidity Contentions served on Jul. 10, 2024 in *Signode Industrial Group LLC* v. *Samuel, Son & Co., Ltd. et al* (E.D. Tex. 2:24-cv-00080-JRG) Exhibit B03—U.S. Pat. No. 5,653,095 ("Stamm") vs. Asserted Claims of the '418 Patent (243 pages).
Invalidity Contentions served on Jul. 10, 2024 in *Signode Industrial Group LLC* v. *Samuel, Son & Co., Ltd. et al* (E.D. Tex. 2:24-cv-00080-JRG) Exhibit B04—U.S. Patent App. Pub. No. 2015/0246739 ("Finzo 739") vs. Asserted Claims of the '418 Patent (356 pages).
Invalidity Contentions served on Jul. 10, 2024 in *Signode Industrial Group LLC* v. *Samuel, Son & Co., Ltd. et al* (E.D. Tex. 2:24-cv-00080-JRG) Exhibit B05—U.S. Pat. No. 2,986,376 ("Falck-Pedersen") vs. Asserted Claims of the '418 Patent (174 pages).
Invalidity Contentions served on Jul. 10, 2024 in *Signode Industrial Group LLC* v. *Samuel, Son & Co., Ltd. et al* (E.D. Tex. 2:24-cv-00080-JRG) Exhibit B06—U.S. Pat. No. 7,089,970 ("Bernard") vs. Asserted Claims of the '418 Patent (117 pages).
Invalidity Contentions served on Jul. 10, 2024 in *Signode Industrial Group LLC* v. *Samuel, Son & Co., Ltd. et al* (E.D. Tex. 2:24-cv-00080-JRG) Exhibit B07—U.S. Pat. No. 3,586,572 ("Ericsson") vs. Asserted Claims of the '418 Patent (226 pages).
Invalidity Contentions served on Jul. 10, 2024 in *Signode Industrial Group LLC* v. *Samuel, Son & Co., Ltd. et al* (E.D. Tex. 2:24-cv-00080-JRG) Exhibit B08—U.S. Pat. No. 3,718,526 ("Annis") vs. Asserted Claims of the '418 Patent (212 pages).
Invalidity Contentions served on Jul. 10, 2024 in *Signode Industrial Group LLC* v. *Samuel, Son & Co., Ltd. et al* (E.D. Tex. 2:24-cv-00080-JRG) Exhibit B09—Fromm P331 Deviceô1 ("Fromm P331 Device") vs. Asserted Claims of the '418 Patent (226 pages).
Invalidity Contentions served on Jul. 10, 2024 in *Signode Industrial Group LLC* v. *Samuel, Son & Co., Ltd. et al* (E.D. Tex. 2:24-cv-00080-JRG) Exhibit B10—U.S. Pat. No. 9,403,609 ("Bonifazi") vs. Asserted Claims of the '418 Patent (245 pages).
Invalidity Contentions served on Jul. 10, 2024 in *Signode Industrial Group LLC* v. *Samuel, Son & Co., Ltd. et al* (E.D. Tex. 2:24-cv-00080-JRG) Exhibit B11—SIAT GT One User's Manual / Siat Gt One Device ("Siat Gt One")ô1 vs. Asserted Claims of the '418 Patent (78 pages).
Invalidity Contentions served on Jul. 10, 2024 in *Signode Industrial Group LLC* v. *Samuel, Son & Co., Ltd. et al* (E.D. Tex. 2:24-cv-00080-JRG) Exhibit B12—U.S. Pat. No. 9,346,572 ("Leppert") vs. Asserted Claims of the '418 Patent (154 pages).
Invalidity Contentions served on Jul. 10, 2024 in *Signode Industrial Group LLC* v. *Samuel, Son & Co., Ltd. et al* (E.D. Tex. 2:24-cv-00080-JRG) Exhibit B13—U.S. Pat. No. 10,308,383 ("Boss") vs. Asserted Claims of the '418 Patent (102 pages).
Invalidity Contentions served on Jul. 10, 2024 in *Signode Industrial Group LLC* v. *Samuel, Son & Co., Ltd. et al* (E.D. Tex. 2:24-cv-00080-JRG) Exhibit B14—U.S. Patent App. Pub. No. 2012/0210682 ("Gardner") vs. Asserted Claims of the '418 Patent (100 pages).
Invalidity Contentions served on Jul. 10, 2024 in *Signode Industrial Group LLC* v. *Samuel, Son & Co., Ltd. et al* (E.D. Tex. 2:24-cv-00080-JRG) Exhibit B15—Fromm P328 Manual and Fromm P328 Deviceô1 ("Fromm P328") vs. Asserted Claims of the '418 Patent (135 pages).
Invalidity Contentions served on Jul. 24, 2024 in *Signode Industrial Group LLC* v. *Samuel, Son & Co., Ltd. et al* (E.D. Tex. 2:24-cv-00080-JRG)—"Defendants' Initial Invalidity Contentions—U.S. Pat. No. 11,932,430" (52 pages).
Invalidity Contentions served on Jul. 24, 2024 in *Signode Industrial Group LLC* v. *Samuel, Son & Co., Ltd. et al* (E.D. Tex. 2:24-cv-00080-JRG)—Exhibit C01 U.S. Pat. No. 5,653,095 ("Stamm") vs. Asserted Claims of U.S. Pat. No. 11,932,430 (48 pages).
Invalidity Contentions served on Jul. 24, 2024 in *Signode Industrial Group LLC* v. *Samuel, Son & Co., Ltd. et al* (E.D. Tex. 2:24-cv-00080-JRG)—Exhibit C02 U.S. Patent Application Pub. No. US 2011/0056391 A1 ("Neeser") vs. Asserted Claims of U.S. Pat. No. 11,932,430 (80 pages).
Invalidity Contentions served on Jul. 24, 2024 in *Signode Industrial Group LLC* v. *Samuel, Son & Co., Ltd. et al* (E.D. Tex. 2:24-cv-00080-JRG)—Exhibit C03 U.S. Patent Application Pub. No. US 2012/0210682A1 ("Gardner") vs. Asserted Claims of U.S. Pat. No. 11,932,430 (55 pages).
Invalidity Contentions served on Jul. 24, 2024 in *Signode Industrial Group LLC* v. *Samuel, Son & Co., Ltd. et al* (E.D. Tex. 2:24-cv-00080-JRG)—Exhibit C04 U.S. Pat. No. 4,313,779 ("Nix") vs. Asserted Claims of U.S. Pat. No. 11,932,430 (49 pages).
Invalidity Contentions served on Jul. 24, 2024 in *Signode Industrial Group LLC* v. *Samuel, Son & Co., Ltd. et al* (E.D. Tex. 2:24-cv-00080-JRG)—Exhibit C05 U.S. Pat. No. 3,032,075 (Hall) vs. Asserted Claims of U.S. Pat. No. 11,932,430 (49 pages).
Invalidity Contentions served on Jul. 24, 2024 in *Signode Industrial Group LLC* v. *Samuel, Son & Co., Ltd. et al* (E.D. Tex. 2:24-cv-00080-JRG)—Exhibit C06 U.S. Pat. No. 6,578,337 ("Scholl") vs. Asserted Claims of U.S. Pat. No. 11,932,430 (48 pages).
Invalidity Contentions served on Jul. 24, 2024 in *Signode Industrial Group LLC* v. *Samuel, Son & Co., Ltd. et al* (E.D. Tex. 2:24-cv-00080-JRG)—Exhibit C07 U.S. Pat. No. 6,328,087 ("Finzo") vs. Asserted Claims of U.S. Pat. No. 11,932,430 (51 pages).
Invalidity Contentions served on Jul. 24, 2024 in *Signode Industrial Group LLC* v. *Samuel, Son & Co., Ltd. et al* (E.D. Tex. 2:24-cv-00080-JRG)—Exhibit C08 U.S. Pat. No. 7,073,431 ("Chen") vs. Asserted Claims of U.S. Pat. No. 11,932,430 (44 pages).
Invalidity Contentions served on Jul. 24, 2024 in *Signode Industrial Group LLC* v. *Samuel, Son & Co., Ltd. et al* (E.D. Tex. 2:24-cv-00080-JRG) - Exhibit C09 U.S. Pat. No. 9,403,609 ("Bonifazi") vs. Asserted Claims of U.S. Pat. No. 11,932,430 (60 pages).
Invalidity Contentions served on Jul. 24, 2024 in *Signode Industrial Group LLC* v. *Samuel, Son & Co., Ltd. et al* (E.D. Tex. 2:24-cv-00080-JRG)—Exhibit C10 U.S. Pat. No. 6,895,733 ("Nix (733)") vs. Asserted Claims of U.S. Pat. No. 11,932,430 (34 pages).
Invalidity Contentions served on Jul. 24, 2024 in *Signode Industrial Group LLC* v. *Samuel, Son & Co., Ltd. et al* (E.D. Tex. 2:24-cv-00080-JRG)—Exhibit C11 U.S. Patent Application Pub. No. US2016/0107775 ("Amacker") vs. Asserted Claims of U.S. Pat. No. 11,932,430 (82 pages).
Invalidity Contentions served on Jul. 24, 2024 in *Signode Industrial Group LLC* v. *Samuel, Son & Co., Ltd. et al* (E.D. Tex. 2:24-cv-00080-JRG)—Exhibit C12 U.S. Pat. No. 4,488,926 ("Rauch") vs. Asserted Claims of U.S. Pat. No. 11,932,430 (40 pages).
Invalidity Contentions served on Jul. 24, 2024 in *Signode Industrial Group LLC* v. *Samuel, Son & Co., Ltd. et al* (E.D. Tex. 2:24-cv-00080-JRG)—Exhibit C13 Cyklop CB 130 ("CB 130") vs. Asserted Claims of U.S. Pat. No. 11,932,430 (72 pages).
Invalidity Contentions served on Jul. 24, 2024 in *Signode Industrial Group LLC* v. *Samuel, Son & Co., Ltd. et al* (E.D. Tex. 2:24-cv-00080-JRG)—Exhibit C14 U.S. Patent Application Pub. No. US 2011/0056392 A1 ("Neeser II") vs. Asserted Claims of U.S. Pat. No. 11,932,430 (67 pages).
Invalidity Contentions served on Jul. 24, 2024 in *Signode Industrial Group LLC* v. *Samuel, Son & Co., Ltd. et al* (E.D. Tex. 2:24-cv-00080-JRG)—Exhibit C15 U.S. Pat. No. 9,346,572 ("Leppert") vs. Asserted Claims of U.S. Pat. No. 11,932,430 (35 pages).
Invalidity Contentions served on Jul. 24, 2024 in *Signode Industrial Group LLC* v. *Samuel, Son & Co., Ltd. et al* (E.D. Tex. 2:24-cv-00080-JRG)—Exhibit C16 Secondary References to be Used in Combination With Other References U.S. Pat. No. 2,936,156 ("Coupland") European Patent EP1008520B1 ("Harada") U.S. Pat. No. 4,015,643 ("Cheung") U.S. Pat. No. 3,028,885 ("Leslie") U.S. Pat. No. 3,284,049 ("Haraden") U.S. Pat. No. 3,586,572 ("Ericsson") U.S. Pat. No. 3,718,526 ("Annis") vs. Asserted Claims of U.S. Pat. No. 11,932,430 (63 pages).
Lieferschein eines Gebrauchtexemplars Cyklop CB 130 (4 pages).
Non-Final Office Action on U.S. Appl. No. 16/277,574 Dated Jan. 25, 2021 (9 pages).

(56) References Cited

OTHER PUBLICATIONS

Non-Final Office Action on U.S. Appl. No. 17/514,142 dated Mar. 28, 2024 (7 pages).
Notice of Reasons for Refusal on JP Patent Application No. 2019/513774, dated Feb. 25, 2020 (15 pages).
Omni-Tuff—03-ITA24 & 03-ITA25 User Reference "Battery Powered Strapping Tools" Omni-tuff Group (10 pages).
Orgapack—OR-H 20 A Operating and Safety Instructions "Hand tool for steel strapping" Orgapack, dated May 2001 (62 pages).
Orgapack—OR-T 120 Operating Manual "Battery-operated hand tool for plastic strapping," Orgapack, Oct. 2015 (36 pages).
Orgapack—OR-T 130/260/450 Operating Manual "Battery-operated hand tool for plastic strapping," Orgapack, Mar. 2017 (28 pages).
Orgapack—OR-T 200 Operating Manual and Spare Parts List "Battery-hand tool for plastic strapping," Dec. 2008 (53 pages).
Orgapack—OR-T 200 Operating Manual "Battery-hand tool for plastic strapping," Traditional Tool Repair Inc., Feb. 2004 (31 pages).
Orgapack—OR-T 250 Operating Manual "Battery-hand tool for plastic strapping," Distributed by Kraft, Jul. 2009 (36 pages).
Orgapack—OR-T 250 Operating Manual "Battery-hand tool for plastic strapping," Traditional Tool Repair Inc., Jul. 2009 (33 pages).
Orgapack—OR-T 250 Operating Manual and Spare Parts List "Battery-hand tool for plastic strapping," Jul. 2015 (34 pages).
Orgapack—OR-T 400 Operating Manual "Battery-hand tool for plastic strapping," Orgapack, Sep. 2009 (36 pages).
Orgapack—OR-T 400 Operating Manual "Battery-hand tool for plastic strapping," Traditional Tool Repair Inc., Sep. 2009 (33 pages).
Orgapack Operating and Safety Instructions OR-T 50 From Serie No. 50/61650 Hand tool for plastic strapping, pp. 1-19, dated Dec. 2006 (19 pages).
Orgapack OR-T 130/260/450 "Quick Guide" distributed by The Packaging Group, dated Feb. 2017 (4 pages).
Orgapack ORT 250&400—setting strap tension by quick pak inc. wmv Video, https://www.youtube.com/watch?v=l49L9hMeaOM, published on YouTube by user quickpackinc (Mike Cunningham) on Jul. 19, 2011. (1 page).
Orgapack, Hand Tools For Plastic Strapping, https://web.archive.org/web/20130319062730/http://www.orgapack.com/Portaldata/4/Resources/info_center/downloads/PTool_EN.pdf, dated Mar. 19, 2013 (8 pages).
PAC Strapping—VT530(HELIOS H-45)"Battery-Powered Manual Tool for Plastic Strapping" Operation Manual and Spare Parts List, PAC Strapping, Jul. 7, 2007 (27 pages).
PAC Strapping—VT550L/VT700L "Plastic Strapping Tools Battery Powered Tool Solutions." Marketing Brochure, PAC Strapping, 2015 (1 page).
PAC Strapping—VT550L/VT700L(H-45L) "Battery-Powered Strapping Tool" Operation, Safety and Spare Parts Manual, PAC Strapping, Oct. 2015 (28 pages).
PAC Strapping—VT700L(H-45L) "Battery-Powered Strapping Tool" Operation and Spare Parts Manual, PAC Strapping, Jun. 2011 (28 pages).
Polychem—B1200 "Polychem News You Can Use," News Release, Polychem Corporation vol. 11, Issue 1, Dated Apr. 2015 (1 page).
Polychem Corporation—B1200 "Battery Powered Plastic Strapping Tool" Operation Manual, Downloaded from www.Manualslib.com, Oct. 2014 (32 pages).
Polychem Corporation—B400 "Battery Powered Plastic Strapping Tool" Operation Manual/Spare Parts List, Polychem Corporation, Sep. 2011 (20 pages).
Samuel—STL-3SD "Model STL-3 Series Battery Operated Plastic Strapping Tool for Polyester and Polypropylene," Information Sheet, Samuel Packaging Systems Group, dated Jun. 2019 (2 pages).
Screenshot of Signode BXT3 battery powered strapping tool Article on IPS Packaging, taken on Jul. 19, 2017 (1 page).
Second screenshot of a Website1 (Wayback Machine used) dated Jul. 3, 2010, evidencing that the "Cyklop CB 130" tool could be routinely purchased (1 page).
Service Manual des Umreifungsgerats P350 datiert auf dem May 2006 (82 pages).
SIAT—GT-ONE "GT One" Operating Manual, dated Apr. 2016 (102 pages).
SIAT—GT-Series Datasheet "Battery Strapping Tools for PP/PET" dated Jun. 2021 (2 pages).
SIAT—GT-Smart "Battery Strapping Tools for Plastic Strap," Smart Brochure (English), Jan. 2020 (4 pages).
SIAT—GT-Smart "Flejadora GT-Smart" GT-Smart Technical Sheet (Spanish) (4 pages).
SIAT—GT-Smart Youtube Video https://www.youtube.com/watch?v=74OZCJi5drc&list=PLS5ECi83i7Xql89eVLTynUhfEGWOSfcn8&index=6, posted by user SIAT S.p.A., dated May 9, 2016 (1 page).
SIAT—GTH 19-25 "GT19-25" Operating Manual, PDF dated May 31, 2016 (102 pages).
Signode—"Signode Introduces BXT3 Plastic Strapping Tool" Press Release, published on AICC dated Jun. 18, 2018 (2 pages).
Signode—BPT-L19 Service Manual "Battery-operated strapping tool for steel strapping 13, 16, 19 mm," Evers GmbH, dated Nov. 24, 2021 (41 pages).
Signode—BST/BPT Series Data Sheet "Battery Powered Tools for Steel Strapping," Signode, dated 2021 (2 pages).
Signode—BXT2 "BXT2-19 Maintenance Manual," dated Mar. 2011 (33 pages).
Signode—BXT2 Operating Manual "Battery-Hand Tool for Plastic Strapping," Downloaded from http://www.manualslib.com/, dated Jul. 2009 (36 pages).
Signode—BXT3-13/16/19 Operating Manual "Battery-operated hand tool for plastic strapping," Signode, dated Feb. 2020 (28 pages).
Signode—BXT3-13/16/19 Quick Manual "Quick Guide" Signode, dated Feb. 2017 (4 pages).
Signode—BXT3-13/16/19 Service Manual "Battery-operated hand tool for plastic strapping," Signode, dated Jun. 30, 2017 (37 pages).
Signode—BXT3-32 "BXT3-32 Battery-operated strapping tool for plastic strapping" Operating Manual, Signode, dated Apr. 2021 (26 pages).
Signode—BXT3-32 "BXT3-32 Data Sheet Hand tool for plastic strapping," Signode, dated May 26, 2021 (2 pages).
Signode—BXT4-16 "Bxt4-16" Product Description from https://www.allstrap.com/bxt4-16, published 2024 (2 pages).
Signode—GRIPPACK "Battery Powered Tensioner," Signode, dated Oct. 2014 (28 pages).
Signode—GripPack RCBS/RCBD Data Sheet "Battery-powered sealer for steel strap," Signode Industrial Group, dated 2018 (2 pages).
Signode Operation, Parts and safety manual, VXT2-16/19 Tension-Weld Strapping Tool, pp. 1-36, Dated May 2003 (36 pages).
Strapex—STB 63 Operating Manual "Battery-hand tool for plastic strapping" Downloaded from http://www.manualslib.com/, dated Oct. 11, 2005 (53 pages).
Strapex—STB 65 Operating Manual "Battery-hand tool for plastic strapping" Downloaded from http://www.manualslib.com/, dated Oct. 11, 2005 (53 pages).
Strapex—STR 64 Operating Manual "Pneumatic hand tool for steel strapping" Downloaded from http://www.manualslib.com/, dated Dec. 18, 2009 (47 pages).
Titan—Hpe-L "Hpe-L 224 0002000 Combined strapping tool for steel strap" Operating Manual, Titan, PDF dated 2011 (15 pages).
Titan—TA 220/400 "TA 22O Battery powered strapping tool for plastic strap" Operating Instructions, Titan, dated Oct. 19, 2012 (64 pages).
Titan—TA 250/450 "TA 250/TA Battery powered strapping tool for plastic strap" Operating Manual, Titan, PDF dated Sep. 2016 (112 pages).
Titan—TA750 "TA750 Battery powered strapping tool for plastic strap" Operating Manual, Titan, PDF dated 2018 (98 pages).

HAND HELD STRAPPING TOOL

CROSS-REFERENCE TO RELATED APPLICATIONS

The present application is a continuation of U.S. patent application Ser. No. 17/514,142, filed Oct. 29, 2021, which is a continuation of U.S. patent application Ser. No. 16/277,574, filed Feb. 15, 2019, the disclosure of each of which is incorporated herein by reference in its entirety.

BACKGROUND

Tools can receive manual forces to manipulate the tools or actuate components of the tools. Such tools can be manipulated by hand. For example, strapping devices for strapping articles with a strapping band can be manipulated by manual forces.

SUMMARY

At least one aspect is directed to a strapping device. The strapping device can include a handle, a body coupled with the handle, and an actuator. The handle includes an input device and a first switch, the input device including at least one of a trigger, a button, a lever, and a second switch, the input device spaced from the first switch by a biasing element that applies a bias force to the input device. The input device moves from a first state spaced from the first switch to a second state contacting the first switch responsive to receiving a force greater than the bias force. A circuit of the first switch is closed responsive to the input device moving from the first state to the second state. The first switch outputs an actuation signal responsive to the circuit being closed. The body includes a base and a tensioner. The base includes a strap receiver opposite the tensioner. The actuation signal causes the actuator to move the tensioner from a first tensioner position to a second tensioner position further from the strap receiver than the first tensioner position based on a movement force that is greater than the bias force.

At least one aspect is directed to a strapping device. The strapping device can include a body, a processing circuit, and an actuator. The body includes a base and a tensioner, the base including a strap receiver opposite the tensioner, the tensioner applies a tension force to a strap received by the body. The processing circuit receives an actuation signal and generates a control signal based on the actuation signal. The actuator causes the tensioner to move, responsive to receiving the control signal, from a first tensioner position to a second tensioner position further from the strap receiver than the first tensioner position.

At least one aspect is directed to a method of operating a tool. The method can include outputting, by a first switch of the tool, an actuation signal responsive to an input device closing a circuit of the first switch, the input device including at least one of a trigger, a button, a lever, and a second switch, outputting, by a processing circuit, a control signal responsive to receiving the actuation signal, and moving, by an actuator, a tensioner from a first tensioner position to a second tensioner position further from the base of the tool than the second tensioner position using a movement force greater than a bias force associated with the input device closing the circuit of the first switch.

These and other aspects and implementations are discussed in detail below. The foregoing information and the following detailed description include illustrative examples of various aspects and implementations, and provide an overview or framework for understanding the nature and character of the claimed aspects and implementations. The drawings provide illustration and a further understanding of the various aspects and implementations, and are incorporated in and constitute a part of this specification.

BRIEF DESCRIPTION OF THE DRAWINGS

The accompanying drawings are not intended to be drawn to scale. Like reference numbers and designations in the various drawings indicate like elements. For purposes of clarity, not every component can be labeled in every drawing. In the drawings.

DETAILED DESCRIPTION

Following below are more detailed descriptions of various concepts related to, and implementations of strapping devices (e.g., tools) having angled handles. Strapping devices can fix a strap to a package, such as a box. The strap can be made from various materials, such as steel, nylon, polypropylene, and polyester. The various concepts introduced above and discussed in greater detail below can be implemented in any of numerous ways.

Figure 1:
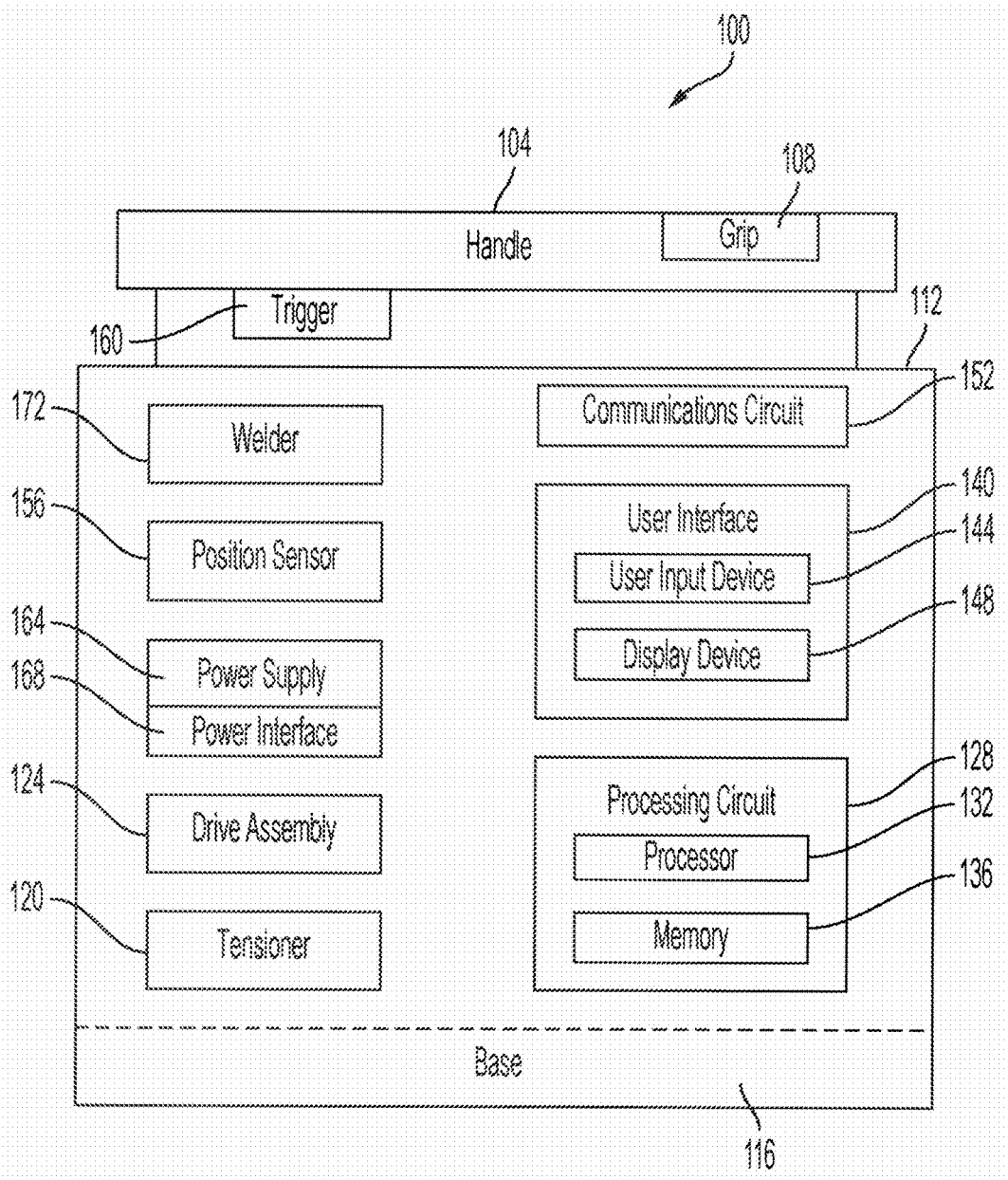
FIG. 1 is a block diagram of an example strapping device.

FIG. 1 depicts a block diagram of a strapping device (or tool) 100. The strapping device 100 can be handheld. For example, the strapping device 100 can have a mass less than a threshold mass (e.g., less than 5 pounds; less than 10 pounds; less than 25 pounds; less than or 50 pounds), to enable the strapping device 100 to be manipulated with a single hand. The strapping device 100 can receive a strap (e.g., two straps on top of one another), apply tension to the strap, such as to secure the strap to a remote component (e.g., a box), and can include a welding element that welds the strap together (e.g., welds the two straps that are on top of one another together).

The strapping device 100 can include at least one handle 104. The handle 104 can be shaped to be held by a hand of a user. The handle 104 can include a grip 108 extending at least partially on the handle 104. The grip 108 can be shaped to receive the hand of the user. The grip 108 can include a relatively high friction surface (e.g., greater friction than a remainder of a surface of the handle 104).

The handle 104 can be coupled with a body 112 of the strapping device 100. For example, the handle 104 can extend between surface portions of the body 112. The handle 104 can allow a user to support the handle 104 to support a mass of the strapping device 100. The handle 104 can extend from an end attached to the body 112. Various components of the strapping device 100 can be disposed in or attached to the body 112. The body 112 can be made of a plastic material.

The body 112 can include at least one base 116 and at least one tensioner 120 coupled with a drive assembly 124. The body 112 can define an opening between the base 116 and the tensioner 120. The strapping device 100 can receive a strap in the opening between the base 116 and the tensioner 120. The drive assembly 124 can cause the tensioner 120 to move towards or away from the base 116, such as to apply a force against the strap when the strapping device 100 receives the strap. For example, the drive assembly 124 can include a servomotor coupled to a cam, lead screw, or linkage to cause the tensioner 120 to move.

The tensioner 120 can include at least one tension gripper wheel. The tensioner 120 can be driven by the drive assembly 124, such as to be rotated by the drive assembly 124. The tensioner 120 can include frictional elements (e.g., ridges, roughened surfaces) to grip the strap. For example, the drive assembly 124 can rotate the tensioner 120, while the tensioner 120 grips the strap, causing the strap to be translated by the tensioner 120. The drive assembly 124 can include separate drive components (e.g., separate motors) to cause the tensioner 120 to move towards or away from the base 116 and to cause the tensioner 120 to rotate. As such, the drive assembly 124 can drive the tensioner 120 to apply a driving force against the strap, increasing tension of the strap relative to a package or other body to which the strap is to be secured. The drive assembly 124 can drive the tensioner 120 towards or away from the strap to contact the tensioner 120 to the strap (and increase a force applied by the tensioner 120 to the strap).

The strapping device 100 can include at least one processing circuit 128. The processing circuit 128 includes a processor 132 and memory 136. The processing circuit 128 can be implemented using a circuit board. Processor 132 can be a general purpose or specific purpose processor, an application specific integrated circuit (ASIC), one or more field programmable gate arrays (FPGAs), a group of processing components, or other suitable processing components. Processor 132 can execute computer code or instructions stored in memory 136 or received from other computer readable media (e.g., CDROM, network storage, a remote server, etc.).

Memory 136 can include one or more devices (e.g., memory units, memory devices, storage devices, etc.) for storing data or computer code for completing or facilitating the various processes described in the present disclosure. Memory 136 can include random access memory (RAM), read-only memory (ROM), hard drive storage, temporary storage, non-volatile memory, flash memory, optical memory, or any other suitable memory for storing software objects or computer instructions. Memory 136 can include database components, object code components, script components, or any other type of information structure for supporting the various activities and information structures described in the present disclosure. Memory 136 can be communicably connected to processor 132 via processing circuit 128 and may include computer code for executing (e.g., by processor 132) one or more processes described herein. When processor 132 executes instructions stored in memory 136, processor 132 generally configures the processing circuit 128 to complete such activities.

The strapping device 100 can include at least one user interface 140. The user interface 140 can receive user input and present information regarding operation of the strapping device 100. The user interface 140 may include one or more user input devices 144, such as buttons, dials, sliders, keys, or a touch interface (e.g., touch screen) to receive input from a user. The user interface 140 may include one or more display devices 148 (e.g., OLED, LED, LCD, CRT displays), speakers, tactile feedback devices, or other output devices to provide information to a user. The user interface 140 can output information regarding the strapping device 100, such as feedback regarding tensioning or welding operations being performed by the strapping device 100.

The strapping device 100 can include at least one communications circuit 152. The communications circuit 152 can include wired or wireless interfaces (e.g., jacks, antennas, transmitters, receivers, transceivers, wire terminals) for conducting data communications with various systems, devices, or networks. For example, the communications circuit 152 can include an Ethernet card and port for sending and receiving data via an Ethernet-based communications network. The communications circuit 152 can include a WiFi transceiver for communicating via a wireless communications network. The communications circuit 152 can communicate via local area networks (e.g., a building LAN), wide area networks (e.g., the Internet, a cellular network), or conduct direct communications (e.g., NFC, Bluetooth). The communications circuit 152 can conduct wired or wireless communications. For example, the communications circuit 152 can include one or more wireless transceivers (e.g., a Wi-Fi transceiver, a Bluetooth transceiver, a NFC transceiver, a cellular transceiver). The processing circuit 128 can communicate with a remote network (e.g., an internet protocol network) using the communications circuit 152. The communications circuit 152 can output information regarding the strapping device 100 to a remote device, such as a portable electronic device. For example, the processing circuit 128 can cause the communications circuit 152 to output information detected by position sensor 156, as well as status information regarding the strapping device 100, such as if the strapping device needs to be cleaned. The communications circuit 152 can receive operational information that can be used to control operation of the tensioner 120 or the welder 172, such as settings associated with tension to be applied to the strap or a duration of time for which to performing welding.

The strapping device 100 can include at least one position sensor 156. The position sensor 156 can detect at least one of a position or an orientation of the strapping device 100. The position sensor 156 can be on or within the body 112. The position sensor 156 can include one or more accelerometers, gyroscopes, or other devices that can detect the at least one of the position or the orientation of the strapping device 100. The position sensor 156 can output the position or orientation to the processing circuit 128. The position sensor 156 can output the position or orientation as absolute values or values relative to a home position or home orientation. The position sensor 156 or the processing circuit 128 can maintain a home position or orientation and compare the detected position or orientation to the home position or orientation to generate the values relative to the home position or home orientation.

The position sensor 156 can output the at least one of the position or the orientation of the strapping device 100 to the processing circuit 128. The processing circuit 128 (including processing electronics of the position sensor 156 if the position sensor 156 includes processing electronics) can process the at least one of the position or the orientation of the strapping device 100. For example, the processing circuit 128 can monitor a position of the strapping device 100, and detect a drop condition of the strapping device 100 based on the position. The processing circuit 128 can detect the drop condition responsive to a rate of change of the position being greater than a threshold rate of change (the threshold rate of change may correspond to an expected acceleration of the strapping device 100 due to gravity). The processing circuit 128 can monitor an orientation of the strapping device 100 responsive to detecting that the strapping device 100 was dropped. The processing circuit 128 can maintain a count of a number of instances of the strapping device 100 being dropped, such as by incrementing the count responsive to detecting that the strapping device 100 was dropped.

The strapping device 100 can include at least one input device (e.g., trigger, lever, button, switch) 160 coupled with the handle 104. Responsive to being actuated, the trigger 160 can output an actuation signal to the drive assembly 124 to cause operation of the drive assembly 124, such as to adjust a position of the tensioner 120. As described with reference to FIGS. 2-9, the trigger 160 can be coupled with a switch (e.g., switch 252) that outputs the actuation signal responsive to operation of the trigger 160. The trigger 160 can output the actuation signal directly to the drive assembly 124. The trigger 160 can output the actuation signal to the drive assembly 124 via the processing circuit 128. The trigger 160 can output the actuation signal to cause the drive assembly 124 to move the tensioner 120, such as to lift the tensioner 120 away from the base 116 to allow the strap to be received between the tensioner 120 and the base 116 (e.g., prior to applying tension to the strap) or release the strap from between the tensioner 120 and the base 116 (e.g., subsequent to applying tension to the strap).

The strapping device 100 can include or be coupled with at least one energy source 164. The energy source 164 can include a battery, which can be removably coupled with the strapping device 100. For example, the energy source 164 can be removed to allow the energy source 164 to be recharged, or to replace the energy source 164 with a replacement energy source 164. The strapping device 100 can be coupled with the energy source 164 via an energy interface 168, which may allow the strapping device 100 to connect to a remote energy source. The energy source 164 can provide power to various components of the strapping device 100, including the processing circuit 128. The processing circuit 128 can detect a charge level of the energy source 164 and cause the user interface 140 to output an indication of the charge level.

The strapping device 100 can include a welder 172. The welder 172 can be driven by operation of the drive assembly 124 to cause friction with the strap, enabling multiple straps (e.g., two straps adjacent to one another) to be welded together. For example, the drive assembly 124 can receive a weld command from the processing circuit 128 and drive the welder 172 responsive to receiving the weld command, such as to cause the welder 172 to at least one of vibrate and oscillate. As the welder 172 vibrates or oscillates, a weld can be created between the straps using friction.

Referring to FIGS. 2-9, among others, the strapping device 100 is depicted. The strapping device 100 can receive a strap 204 between the tensioner 120 and the base 116. The base 116 can include a first strap receiver 208 along which the strap 204 can be received along a strap axis 212 (e.g., at which the welder 172 can contact the strap 204). The strap axis 212 can extend from an opening between the tensioner 120 and the base 116 (e.g., when the tensioner 120 is spaced from the base 116) and between the first strap receiver 208 and the welder 172. The base 116 can include or be defined by a first body end 216 of the body 112. A second body end 220 of the body 112 can include the energy source 164. The handle 104 can extend from a first handle end 224 proximate to the first body end 216 to a second handle end 228 proximate to the second body end 220.

Figure 6:
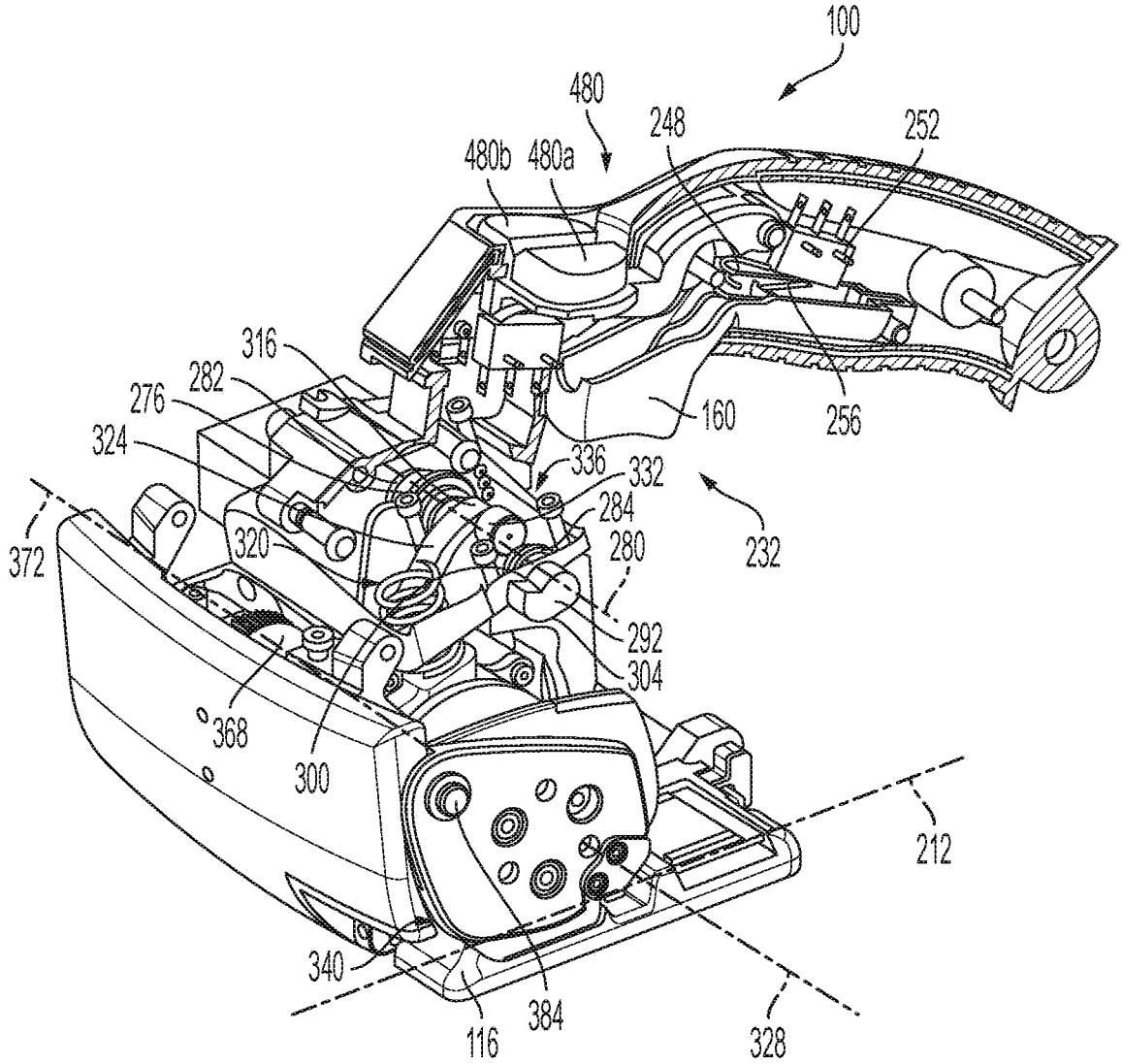
FIG. 6 is a perspective view of an example strapping device having the tensioner in the first position.
Figure 7:
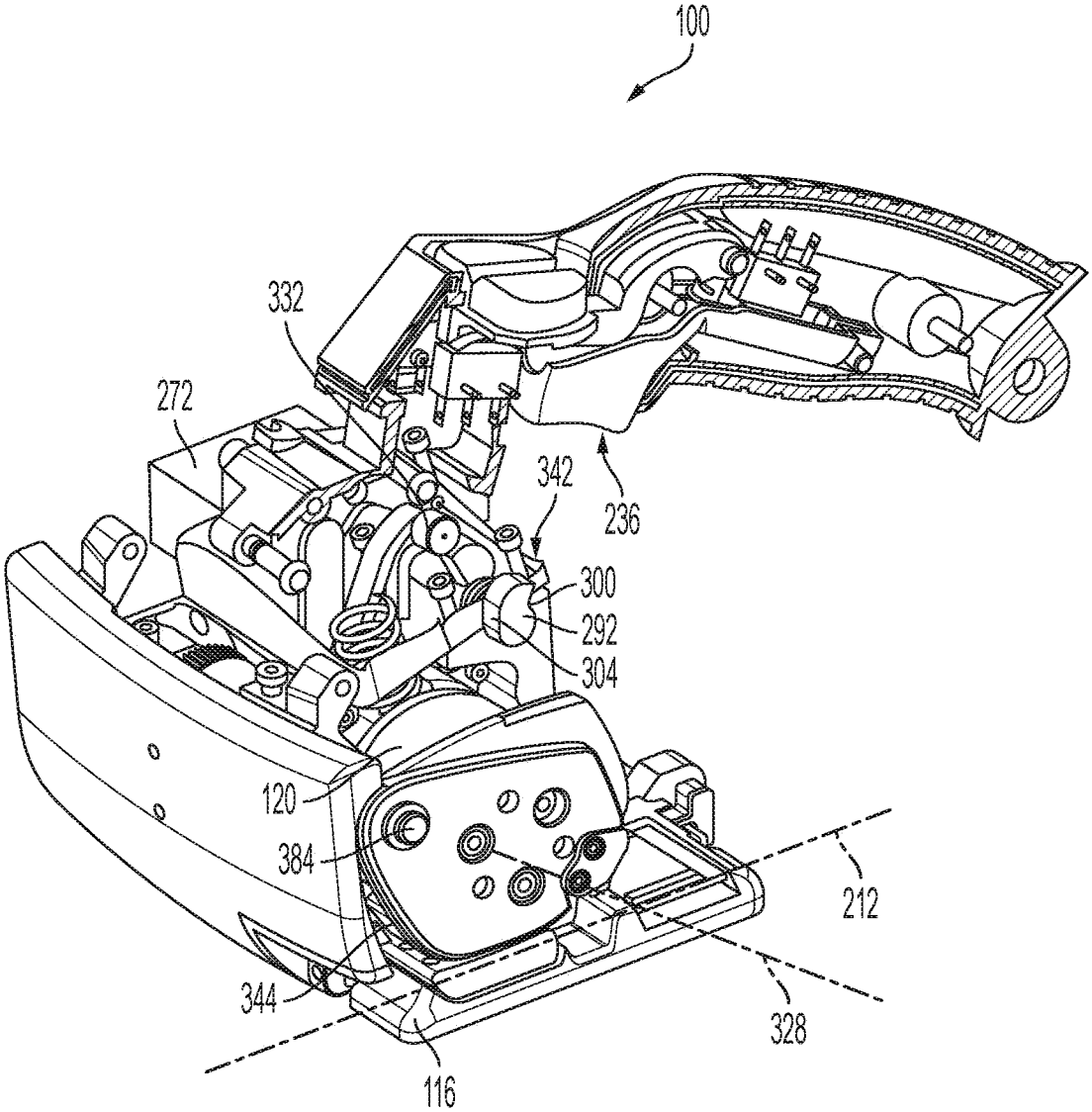
FIG. 7 is a perspective view of an example strapping device having the tensioner in the second position.
Figure 8:
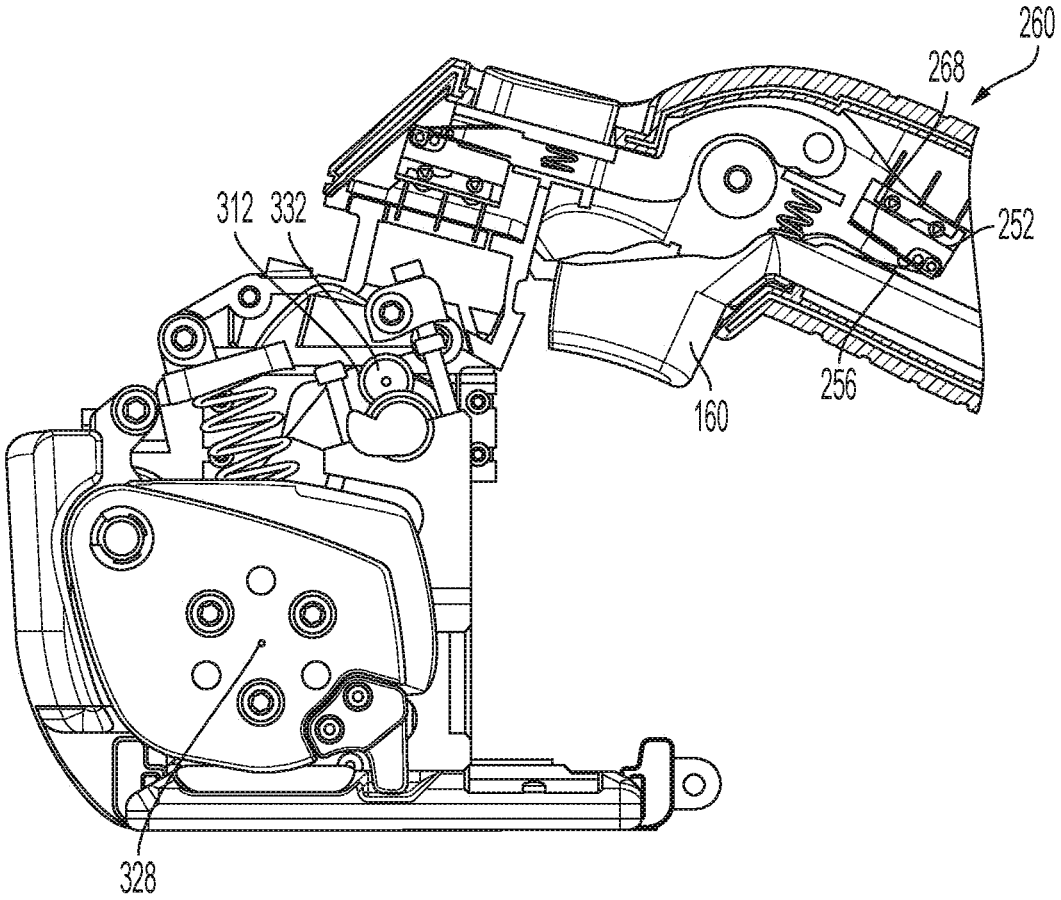
FIG. 8 is a first side view of an example strapping device having the tensioner in the first position.
Figure 9:
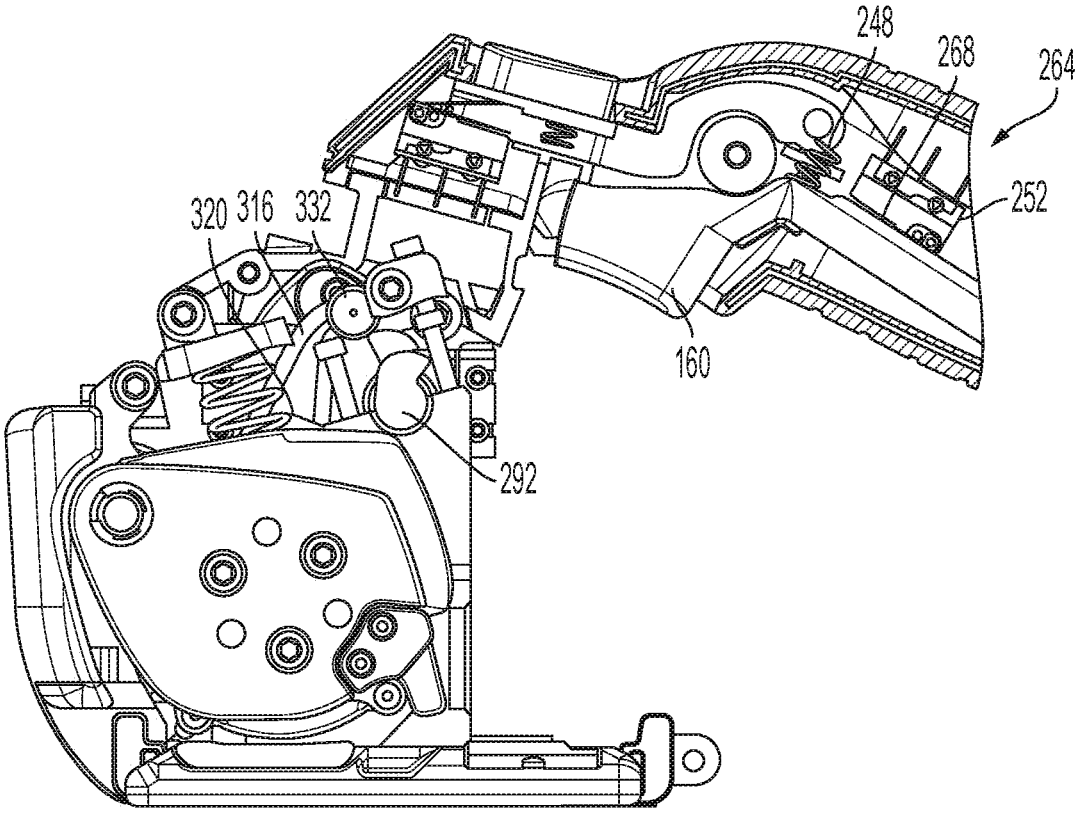
FIG. 9 is a first side view of an example strapping device having the tensioner in the second position.

The trigger 160 can be adjusted from a first state 232, such as depicted in FIG. 6, to a second state 236, such as depicted in FIG. 7. The trigger 160 can be adjusted from the first state 232 to the second state 236 responsive to receiving a force applied to the trigger 160. For example, responsive to receiving a force applied to the trigger 160, the trigger 160 can move from a first position corresponding to the first state 232 to a second position corresponding to the second state 236.

The trigger 160 can be shaped to receive a finger of a user, such as by having a concave surface 244 facing a direction at which a finger of the user is received. The trigger 160 can be sized to receive less than a full hand of the user. For example, a length of the concave surface 244 can be less than a threshold length (e.g., less than 3 inches; less than 2 inches; less than 1 inch).

As described above, the trigger 160 can cause an actuation signal to be provided to the drive assembly 124, such as to translate the tensioner 120 away from the base 116. For example, a biasing element 248 can be disposed between the trigger 160 and a switch 252. The biasing element 248 can include a spring. The biasing element 248 can apply a bias force against the trigger 160 to bias the trigger to the first state 232. The bias force can be less than a threshold bias force at which a user can be expected to be able to move the trigger 160 from the first state 232 to the second state 236.

Systems that use a tensioner to apply force against the strap can have a relatively large lifting force to lift the tensioner away from the strap. The lifting force includes a force used to lift the mass of the tensioner and any components fixed to the tensioner. This mass may be relatively large so that the tensioner can apply a sufficient force against the strap in order to perform strapping operations. A relatively long trigger or handle may be implemented to provide a sufficient lever arm to allow a user to manually lift the tensioner away from the strap by compressing the trigger towards the handle, the trigger being mechanically coupled with the tensioner. Despite the length of the trigger (e.g., the trigger may be long enough so that the user can use four fingers to compress the trigger towards the handle), the relatively small distance between the trigger and the handle (a maximum distance between the trigger and the handle may be limited by a plane of a base of the strapping device along which the strap is received or a package to which the strap is to strapped below the base of the strapping device) may cause a manual trigger force that is converted into the lifting force for lifting the tensioner away from the strap to be relatively large, resulting in strain on the hand of the user when attempting to apply the manual trigger force to the trigger.

The strapping device 100 can use the trigger 160, switch 252, and drive assembly 124 to move the tensioner 120 away from the base 116 without depending on the relatively large manual trigger force to be applied by a user. For example, the bias force of the trigger 160 can be less than the manual trigger force, reducing strain on the hand of the user, reducing the need for a trigger that is long enough for a user to use several fingers to manipulate the trigger, and enabling safer usage of the strapping device 100.

When, for example, the trigger 160 is in the first state 232, a switch element 256 of the switch 252 can be in an open state 260. When the bias force of the biasing element 248 is overcome and the trigger 160 moves to the second state 236, the switch element 256 is moved by the trigger 160 to a closed state 264. Moving the switch element 256 to the closed state 264 contacts a corresponding electrical contact 268 of the switch 252. When the switch element 256 contacts the electrical contact 268, a circuit of the switch 252 is closed, causing the switch 252 to output an actuation signal that causes corresponding operation of the drive assembly 124. The switch 252 can output the actuation signal directly to the drive assembly 124.

The switch 252 can output the actuation signal to the processing circuit 128. The processing circuit 128 can output a control signal to the drive assembly 124 responsive to receiving the actuation signal. The processing circuit 128 can generate the control signal to have a first parameter value (e.g., first voltage) responsive to receiving the actuation signal, the first parameter value causing actuation of the drive assembly 124, and a second parameter value different than the first parameter value while the actuation signal is not received. The processing circuit 128 can output the control signal responsive to receiving the actuation signal, and does not output the control signal while the actuation signal is not received. As such, operation of the switch 252 can selectively cause actuation of the drive assembly 124, such as moving the tensioner 120 away from the base 116 when the switch 252 is switched from the open state 260 to the closed state 264, and moving the tensioner 120 back towards the base 116 when the switch 252 is switched from the closed state 264 to the open state 260.

The drive assembly 124 can include an actuator 272 that receives the control signal from the processing circuit 128 (or the actuation signal directly form the switch 252). The actuator 272 can be actuated responsive to receiving the control signal to cause a resulting motion of the tensioner 120. For example, the actuator 272 can include a rotary actuator or a linear actuator. The actuator 272 can include a servomotor. The servomotor can include a DC motor. The actuator 272 can receive the control signal from the processing circuit 128, and drive the servomotor to a predetermined position responsive to receiving the control signal. For example, the actuator 272 can maintain the predetermined position in memory and retrieve the predetermined position responsive to receiving the control signal. The processing circuit 128 can generate the control signal to indicate the predetermined position. The actuator 272 can cause the tensioner 120 to move towards or away from the base 116 using various components, such as a cam 292 as described herein, a lead screw, or a linkage.

The actuator 272 can be coupled with a cam shaft 276. The cam shaft 276 can be coupled with a motor of the actuator 272, such as a servomotor. The cam shaft 276 can extend into the actuator 272. The cam shaft 276 extends along a shaft axis 280. The cam shaft 276 is spaced from the strap axis 212. A projection of the shaft axis 280 into a plane parallel to the base 116 in which the strap axis 212 can lie can be perpendicular to the strap axis 212.

The actuator 272 can rotate the cam shaft 276 to drive various components coupled with the cam shaft 276 as described further herein. For example, the actuator 272 can be coupled with the cam shaft 276 to transfer torque to the cam shaft 276. The actuator 272 can rotate the cam shaft 276 using a maximum torque portion of a range of motion of the actuator 272. For example, the actuator 272 can have a 180 degree range of motion, while rotating the cam shaft 276 by a selected angle (e.g., 70 degrees; greater than or equal to 55 degrees and less than or equal to 85 degrees; greater than or equal to 65 degrees and less than or equal to 75 degrees) responsive to receiving the control signal, the selected angle corresponding to a range of rotation including a maximum torque point of the 180 degree range of motion. The cam shaft 276 extends from a first shaft end 282 proximate to the actuator 272 to a second shaft end 284 distal from the actuator 272.

A cam 292 extends from the cam shaft 276 proximate to the second shaft end 284. The cam 292 can be integrally formed with the cam shaft 276, or can be a separate component attached to the cam shaft 276 at the second shaft end 284. The cam 292 extends transverse to the shaft axis 280. The cam 292 includes a first cam wall 300 and a second cam wall 304. The first cam wall 300 can be straight, and the second cam wall 304 can have a convex curvature, such that a radius of the second cam wall 304 (e.g., as measured from the shaft axis 280) varies as a function of distance from the cam shaft 276.

The tensioner 120 is coupled with a lever arm 312. The lever arm 312 is positioned between the tensioner 120 and the actuator 272. For example, as depicted in FIG. 6, the lever arm 312 extends from a first lever end 316 proximate to the cam 292 to a second lever end 320 extending to a lever body 324. The lever body 324 is coupled with the tensioner 120. For example, the lever body 324 can be adjacent to and coaxial with a tensioner axis 328 of the tensioner 120. The lever arm 312 can be radially outward from the tensioner axis 328 (e.g., the first lever end 316 and second lever end 320 are each radially outward from the tensioner axis 328).

The lever arm 312 includes a stop 332. The stop 332 can be adjacent to the second lever end 320, such as by extending from the second lever end 320 in a direction parallel or substantially parallel to the shaft axis 280. The stop 332 can be cylindrical.

Figure 2:
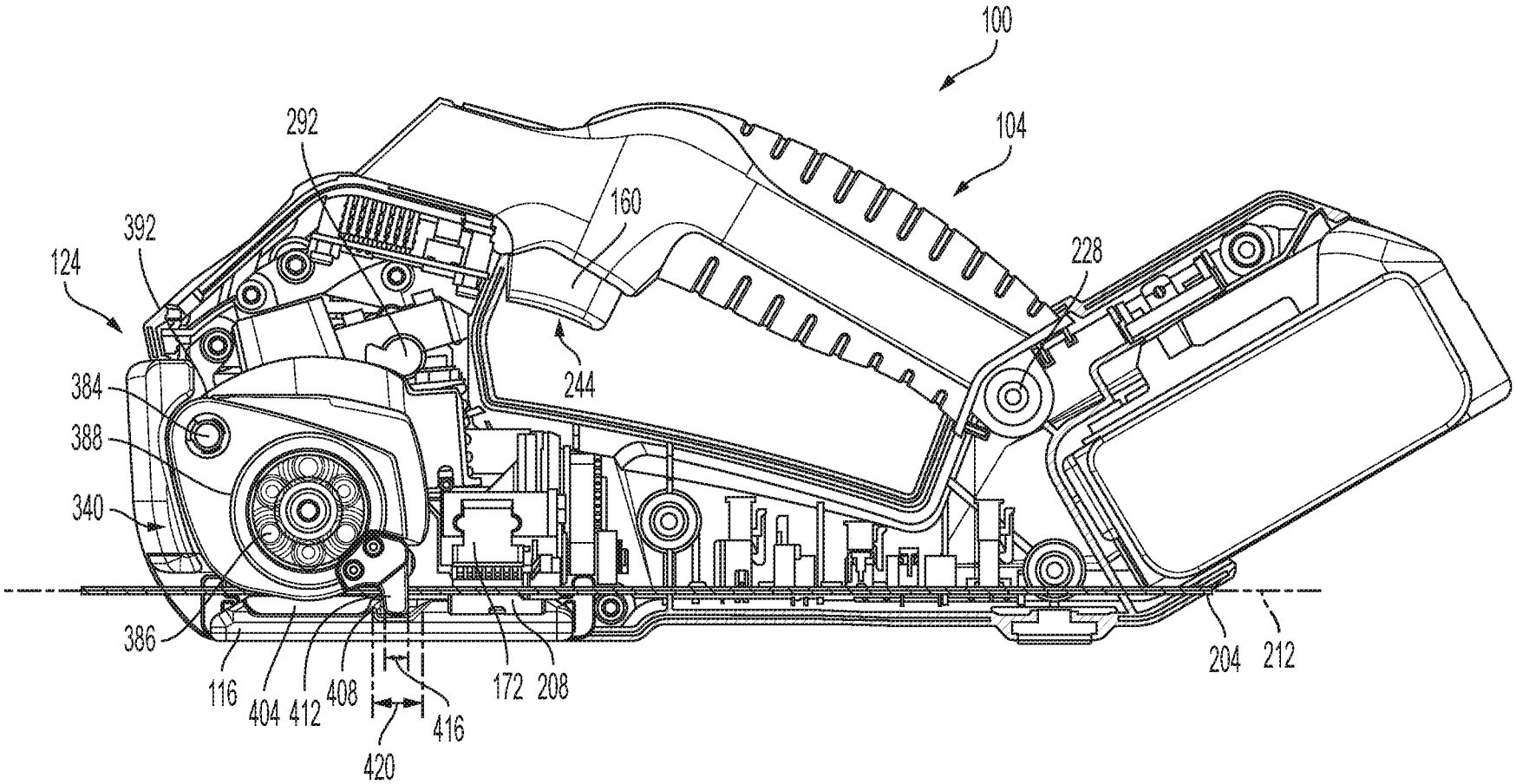
FIG. 2 is a partial first side view of an example strapping device having a tensioner in a first position.

When rotated by the cam shaft 276, the cam 292 can drive the stop 332, and thus the lever arm 312 that the stop 332 is attached to, from a first stop position 336 (e.g., as depicted in FIG. 6) to a second stop position 342 (e.g., as depicted in FIG. 7). As depicted in FIG. 6, when the stop 332 is in the first stop position 336, the stop 332 can be spaced from the second cam wall 304 of the cam 292; a portion of the second cam wall 304 having a relatively small radius relative to a remainder of the second cam wall 304 can contact the stop 332. As the cam 292 is rotated by the cam shaft 276, the second cam wall 304 moves in a generally upward direction (e.g., away from the base 116), and while in contact with the stop 332, applies a force against the stop 332 to cause the stop 332 to move away from the base 116. The tensioner 120 will move from a first tensioner position 340 (e.g., as depicted in FIG. 2) to a second tensioner position 344 (e.g., as depicted in FIG. 2) due to the movement of the stop 332, which is fixed in position relative to the tensioner 120 via the lever body 324. The drive assembly 124 can move the tensioner 120 towards or away from the responsive to the trigger 160 activating the switch 252, based on overcoming a bias force of the biasing element 248 that can be less than a manual trigger force.

Figure 5:
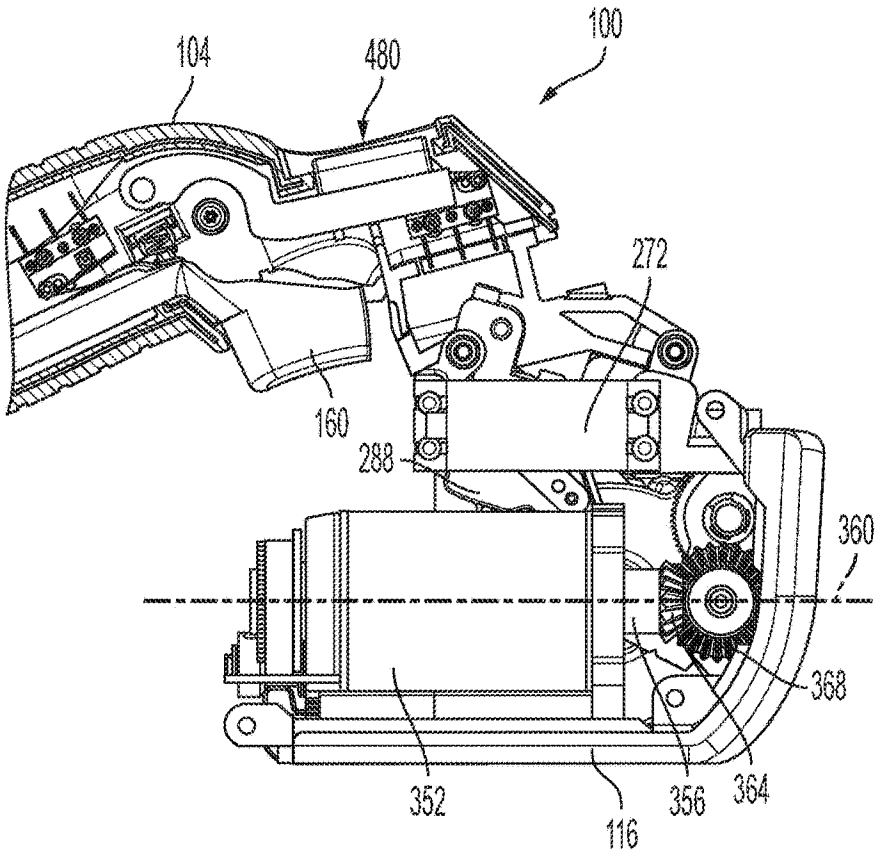
FIG. 5 is a partial second side view of an example strapping device having a user interface element in a second position.
Figure 4:
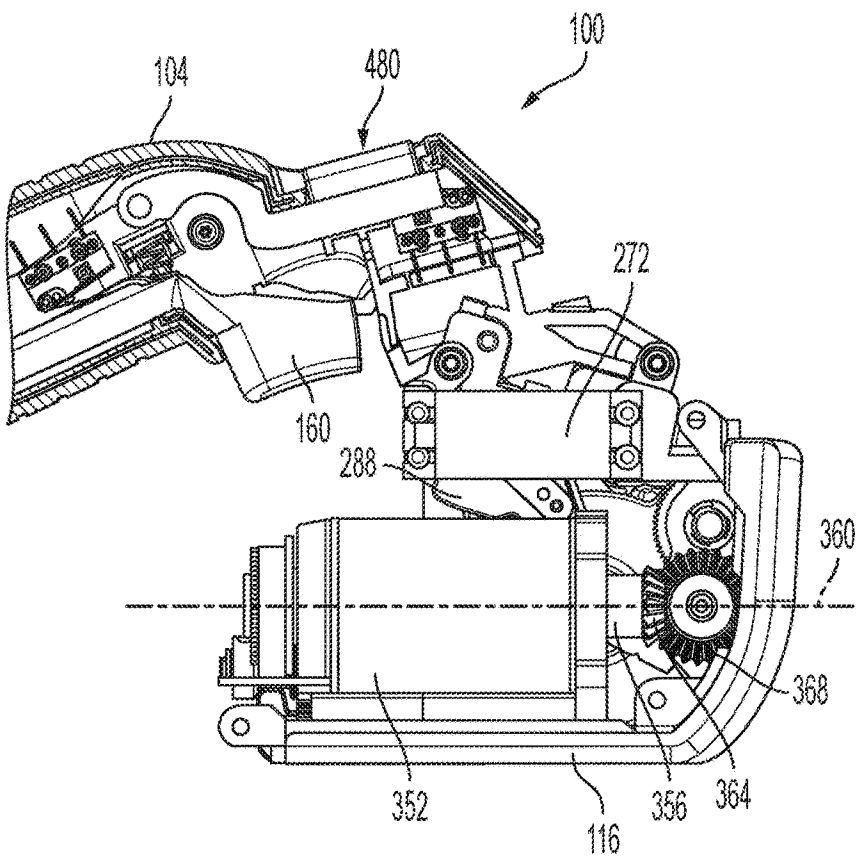
FIG. 4 is a partial second side view of an example strapping device having a user interface element in a first position.

The drive assembly 124 rotates the tensioner 120 about the tensioner axis 328. For example, the drive assembly 124 can include a drive motor 352 coupled with a first drive shaft 356 that rotates about a drive axis 360 of the drive motor 352 and the first drive shaft 356. The first drive shaft 356 can be coupled with the tensioner 120 to cause the tensioner 120 to rotate. As depicted in FIGS. 4-5, the first drive shaft 356 can include a first gear 364 that can rotate about the drive axis 360 as the first drive shaft 356 is rotated. Referring to FIGS. 4-5, among others, the drive axis 360 is, in this example, not coaxial with the tensioner axis 328; the first gear 364 can engage a second gear 368 that rotates about a gear axis 372 perpendicular to the drive axis 360 (and parallel to the tensioner axis 328). The second gear 368 can be coupled with a second drive shaft 376 coupled with a third gear 380, which rotates a third drive shaft 384. The third drive shaft 384 can be radially outward from the tensioner 120 relative to the tensioner axis 328.

As depicted in the example of FIG. 2, the tensioner 120 can have a rotation member 388. The rotation member 388 can be cylindrical, and can rotate about the tensioner axis 328. The drive assembly 124 can include one or more planetary gears 386 coupled to the third drive shaft 384 to be driven (e.g., rotated) by the third drive shaft 384. The one or more planetary gears 386 can be coupled with the rotation member 388, so that rotation of the one or more planetary gears 386 by the third drive shaft 384 rotates the tensioner 120 about the tensioner axis 328. The one or more planetary gears 386 and the rotation member 388 can be disposed in a housing 396 adjacent to an engagement surface 400 of the tensioner 120 that contacts the strap 204 when the tensioner 120 is in the first tensioner position 340.

The base 116 can include a second strap receiver 404 between the tensioner 120 and the base 116. The second strap receiver 404 can include a concave curvature, allowing for an increased surface area of the convex engagement surface 400 of the tensioner 120 to contact the strap 204 relative a flat second strap receiver 404. The base 116 can include or define a slot 408 between the first strap receiver 208 and the second strap receiver 404. The tensioner 120 can include a strap guiding member 412 that extends from the housing 396 and further outward from the tensioner axis 328 than the housing 396. When the tensioner 120 is in the first tensioner position 340, the strap guiding member 412 can be at least partially disposed in a space defined by the slot 408; the strap guiding member 412 can guide the strap 204. A length 416 of the strap guiding member 412 parallel to the strap axis 212 can be less than a length 420 of the slot 408 parallel to the strap axis 212, so that the strap guiding member 412 can move freely out of the slot 408 when the tensioner 120 is moved from the first tensioner position 340 to the second tensioner position 344.

Figure 11:
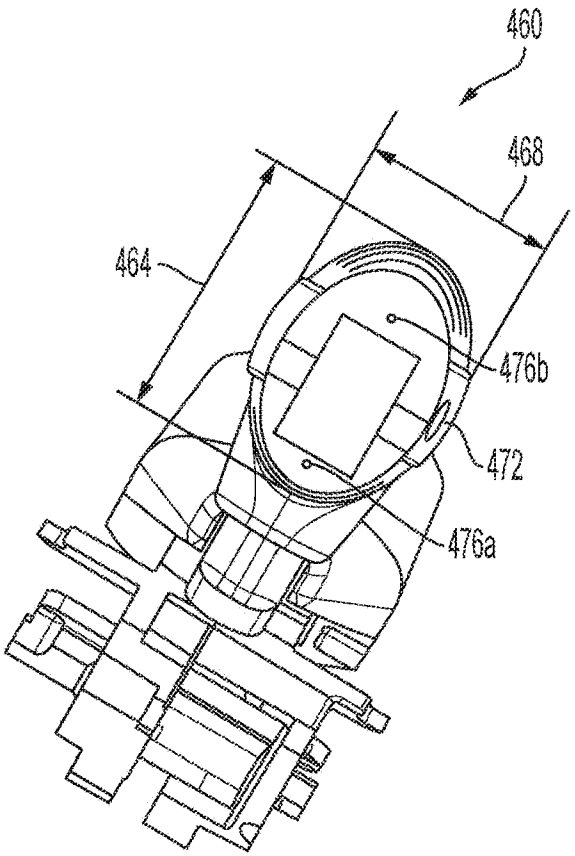
FIG. 11 is a cross-section view of an example handle of a strapping device.
Figure 10:
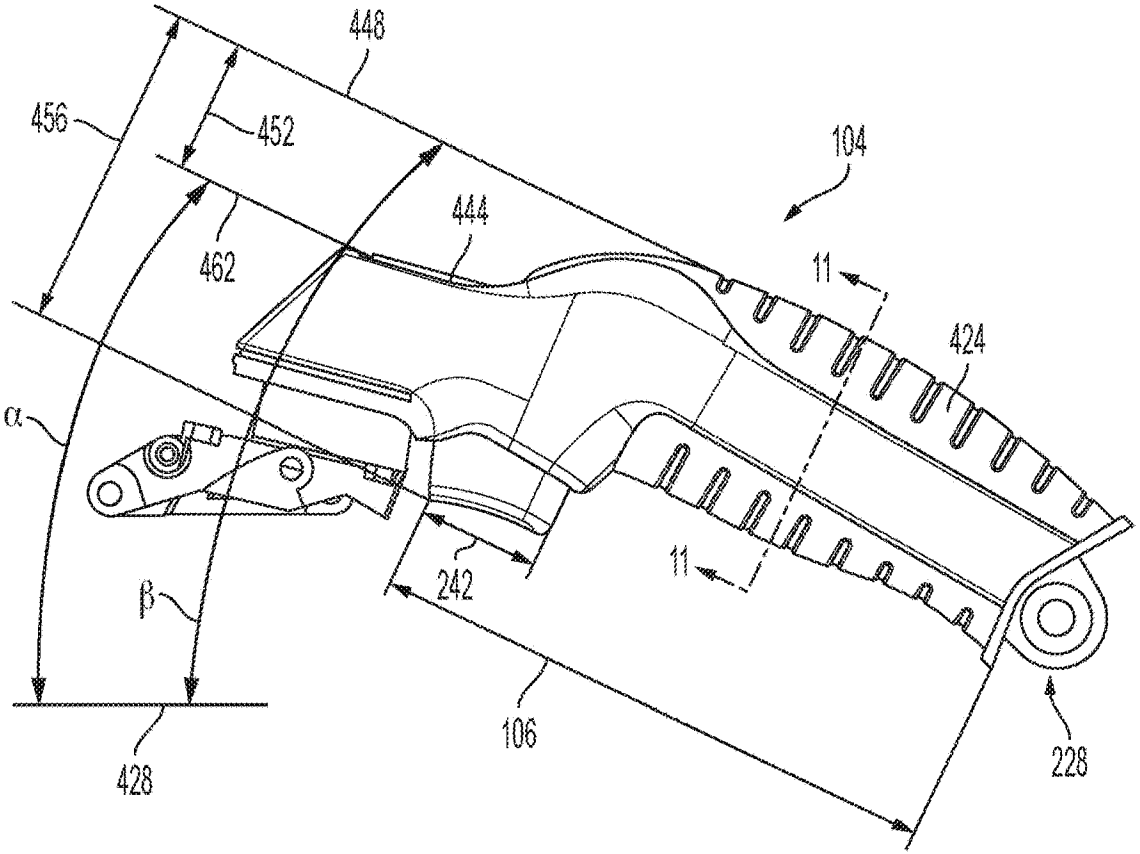
FIG. 10 is a side view of an example handle of a strapping device.

Referring further to FIGS. 2-9 and to FIGS. 10 and 11, the handle 104 can be sized, shaped, or oriented relative to the body 112 to be more effectively manipulated than in systems where the handle (or a trigger attached to the handle) would be used as a mechanical lever to lift the tensioner, the handle may be oriented in a manner that places a wrist of a user in an uncomfortable or ergonomically undesirable position. A center of mass of a tool that includes the handle may be offset from a point at which the manual lifting force should be applied to the handle or trigger in order to lift the tensioner, such that a user may need to excessively strain their hand to both support the tool in their hand and apply the manual lifting force to lift the tensioner, including when repeatedly operating the tool. The handle 104 can reduce strain on the hand of the user, such as by orienting the handle 104 relative to the body 108 in a more ergonomic manner or more closely aligning the center of mass of the strapping device 100 with the trigger 160.

The handle 104 extends from the first handle end 224, which is coupled with the body 108 proximate to the first body end 216, to the second handle end 228, which is coupled with the body 108 proximate to the second body end 220. The handle 104 includes the grip 108. The handle 104 can define a length 106 from the first handle end 224 to the second handle end 228. The length 106 can be greater than or equal to 2 inches and less than or equal to 7 inches. The length 106 can be greater than or equal to 3 inches and less than or equal to 6 inches. The length 106 can be greater than or equal to 4 inches and less than or equal to 5 inches. The length 106 can be 4.5 inches.

The handle 104 (e.g., a section 424 of the handle between the first handle end 224 and second handle end 228) can be oriented at an angle $\alpha$ relative to a plane 428 parallel to at least one of the strap axis 212, the base 116, and the strap 204 when the strap 204 is received by the strapping device 100. The plane 428 can be parallel to a level surface when the strapping device 100 is rested on the level surface or perpendicular to gravity when the strapping device 100 is rested on the level surface. The plane 428 can be perpendicular to gravity when the strapping device 100 is supported at a center of mass of the strapping device 100, such that the plane 428 is defined to be horizontal.

The angle $\alpha$ can be defined between the plane 428 and a handle axis 432 of the handle 104. The handle axis 432 can extend through a centroid of the handle 104. The handle axis 432 can be equidistant from a maximum number of points on an outer surface 436 of the handle 104 (e.g., of the section 424). The handle axis 432 can be perpendicular to a plane of a cross-section 438 of the handle 104 that extends through a center 440 of the handle 104, the center 440 of the handle 104 being defined as a point equidistant from the furthest points on either end (e.g., from the first handle end 224 and the second handle end 228) and equidistant between a surface of the handle 104 closest to the strap axis 212 and a portion of the handle 104 furthest from the strap axis 212.

The angle $\alpha$ can be an acute angle, greater than or equal to 15 degrees, or less than or equal to 45 degrees. The angle $\alpha$ can be greater than or equal to 20 degrees or less than or equal to 35 degrees. The angle $\alpha$ can be greater than or equal to 25 degrees or less than or equal to 32 degrees. The angle $\alpha$ can be greater than or equal to 28 degrees or less than or equal to 31 degrees. The angle $\alpha$ can be 30 degrees. By orienting the handle 104 at the angle $\alpha$, the handle 104 can be more easily held by a user, such as by reducing a likelihood that a wrist of the user is in a strained or uncomfortable position while manipulating the strapping device 100.

The trigger 160 can be positioned proximate to a center of gravity of the strapping device 100. For example, the trigger 160 can be within a threshold distance of the center of gravity of the strapping device 100. The threshold distance can be less than or equal to 8 inches (in). The threshold distance can be less than or equal to 4 in. The threshold distance can be less than or equal to 2 in. The threshold distance can be less than or equal to 1 in. The threshold distance can be less than or equal to 0.5 in.

Figure 3:
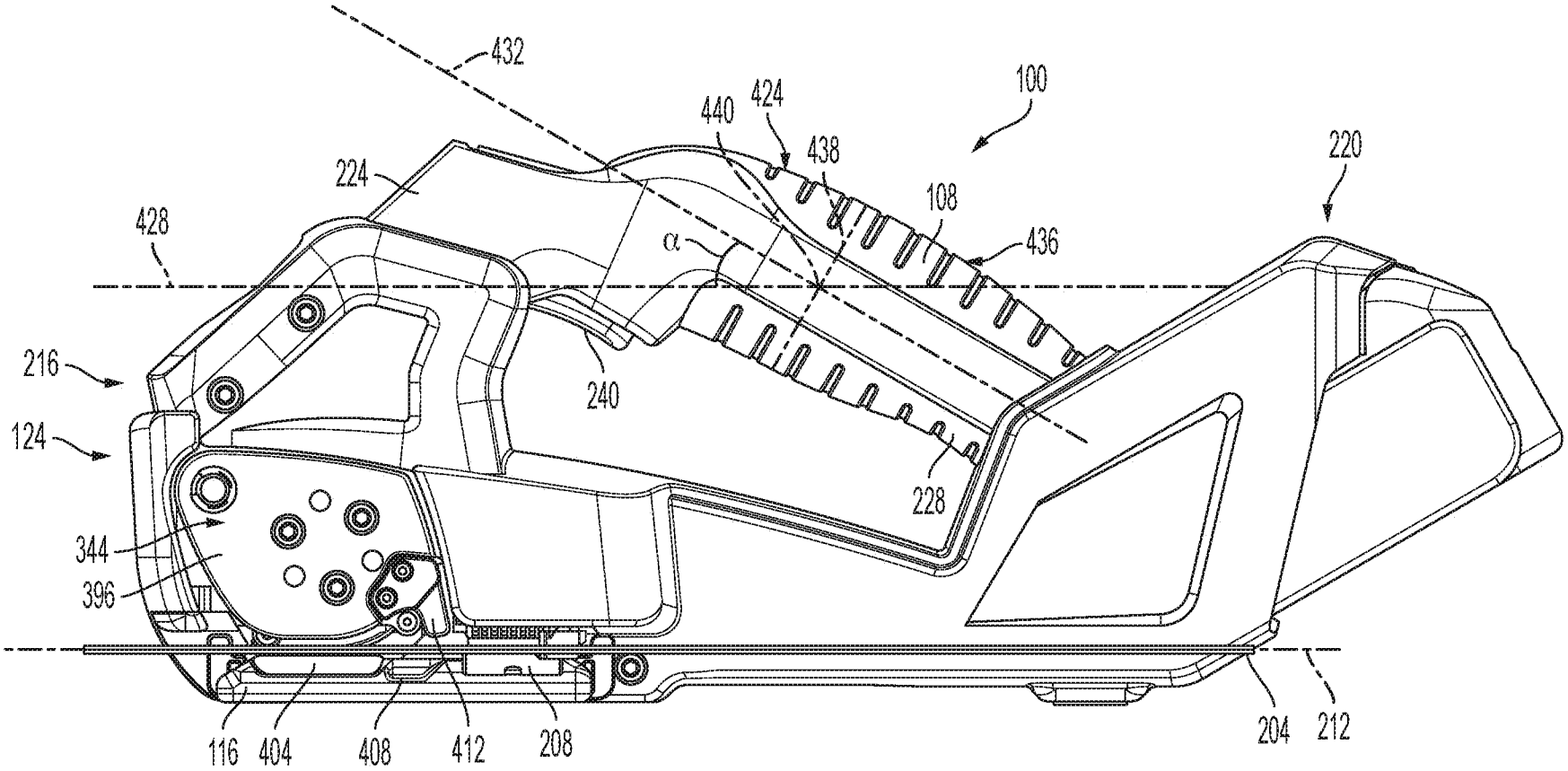
FIG. 3 is a partial first side view of an example strapping device having the tensioner in a second position.

As depicted in FIGS. 3 and 10, the trigger 160 can extend from the handle 104 towards the base 116. By positioning the trigger 160 proximate to the center of gravity of the strapping device 100, the strapping device 100 can reduce strain on the user, as the user need not expend significant effort to simultaneous (1) apply a force against the trigger 160 to cause the trigger 160 to overcome the bias force of the biasing element 248 and move the trigger 160 to the second state 236 and (2) maintain balance of the strapping device 100 while the trigger 160 is being moved (as compared to systems in which the trigger would be spaced relatively far from the center of gravity of the tool, such that the trigger cannot be actuated while the tool is continued to be supported or balanced at the center of gravity). The trigger 160 can have a length 242 measured from a first end of the trigger 160 proximate to the first body end 216 to a second end of the trigger 160 proximate to the second body end 220. The length 242 can be greater than or equal to 0.2 inches and less than or equal to 3 inches. The length 242 can be greater than or equal to 0.4 inches and less than or equal to 2 inches. The length 242 can be greater than or equal to 0.6 inches and less than or equal to 1.8 inches. The length 242 can be greater than or equal to 1 inch and less than or equal to 1.4 inches. The length 242 can be 1.2 inches.

The handle 104 can define an interface surface 444 opposite the base 116. The interface surface 444 can support at least a portion of the user interface 140. The interface surface 444 can be spaced from a tangent 448 extending from the handle 104 by a spacing 452. The spacing 452 can be, for example, less than one inch, greater than or equal to 0.2 inches, or less than or equal to 0.8 inches. The spacing 452 can be greater than or equal to 0.4 inches, or less than or equal to 0.6 inches. The spacing 452 can be 0.5 inches. The spacing 452 can be greater than or equal to 0.55 inches, or less than or equal to 0.60 inches. In some examples, the spacing 452 is between 0.56 and 0.60 inches, e.g. 0.58 inches.

The spacing 452 can be sized to facilitate manipulation of the user interface 140 without moving a finger from the trigger 160, such as to allow a thumb to manipulate the user interface 140 while an index finger is positioned on the trigger 160. The handle 104 can define a spacing 456 between the tangent 448 and the trigger 160. The spacing 456 can be greater than or equal to 0.5 inches and less than or equal to 5 inches. The spacing 456 can be greater than or equal to 1 inch and less than or equal to 3.5 inches. The spacing 456 can be greater than or equal to 2 inches and less than or equal to 3 inches. The spacing 456 can be 2.5 inches.

The interface surface 444 can define an angle β between the plane 428 and a plane 462 in which the interface surface 444 lies. The angle β can be greater than or equal to 5 degrees and less than or equal to 35 degrees. The angle β can be greater than or equal to 8 degrees and less than or equal to 25 degrees. The angle β can be greater than or equal to 10 degrees and less than or equal to 20 degrees. The angle β can be greater than or equal to 12 degrees and less than or equal to 18 degrees. The angle β can be 15 degrees.

The handle 104 can have a cross-sectional shape 460 (e.g., at the plane of the cross-section 438) that is at least one of oval-like and elliptical. For example, the cross-sectional shape 460 can have a maximum diameter 464 perpendicular to a minimum diameter 468, with a perimeter 472 of the cross-sectional shape 460 extending along where the diameters 464, 468 intersect the perimeter 472, the perimeter 472 being curved. The perimeter 472 can be elliptical or substantially elliptical, such that when foci 476*a*, 476*b* of the perimeter 472 are identified based on the diameters 464, 468, each point on the perimeter 472 can be equidistant from the foci 476*a*, 476*b* within a threshold tolerance (e.g., each point on the perimeter 472 is no further than the threshold tolerance from a point that would be equidistance from the foci 476, 476*b* as in an exact ellipse; the threshold tolerance can be no greater than 20 percent of the minimum diameter 468; no greater than 15 percent of the minimum diameter 468; no greater than 10 percent of the minimum diameter 468; no greater than 5 percent of the minimum diameter 468; no greater than 2 percent of the minimum diameter 468; no greater than 1 percent of the minimum diameter 468). The handle 104 may have a smaller cross-sectional area adjacent to the second body end 220 than proximate to the trigger 160. By shaping the cross-sectional shape 460 to be oval-like or elliptical, the handle 104 can be more comfortably held by the hand of a user, including when supporting the weight of the strapping device 100 and manipulating the trigger 160.

Referring further to FIG. 6, the user interface 140 can include a plurality of user interface elements 480. For example, the user interface 410 can include a first user interface element 480*a* corresponding to tension action, and a second user interface element 480*b* corresponding to welding action. The processing circuit 128 can receive a tension signal from the first user interface element 480*a* responsive to manipulation of the first user interface element 480*a*, and control operation of the drive assembly 124 to apply tension to the strap 204 responsive to receiving the tension signal. The processing circuit 128 can receive a welding signal from the second user interface element 480*b* responsive to manipulation of the second user interface element 480*b*, and control operation of drive assembly 124, including the drive motor 352, to drive the welder 172 responsive to receiving the welding signal.

Figure 13:
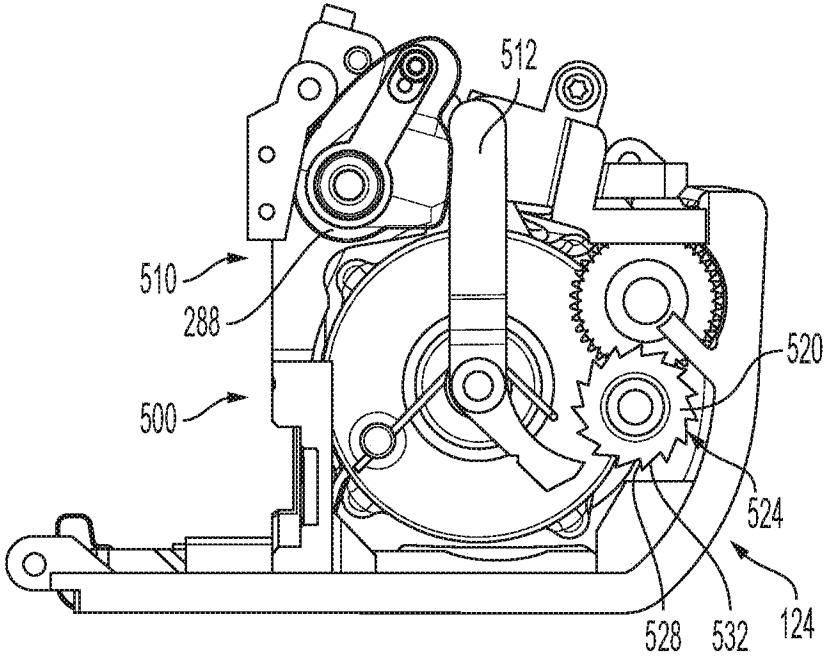
FIG. 13 is a side view of an example ratchet assembly of a strapping device in a second configuration.
Figure 12:
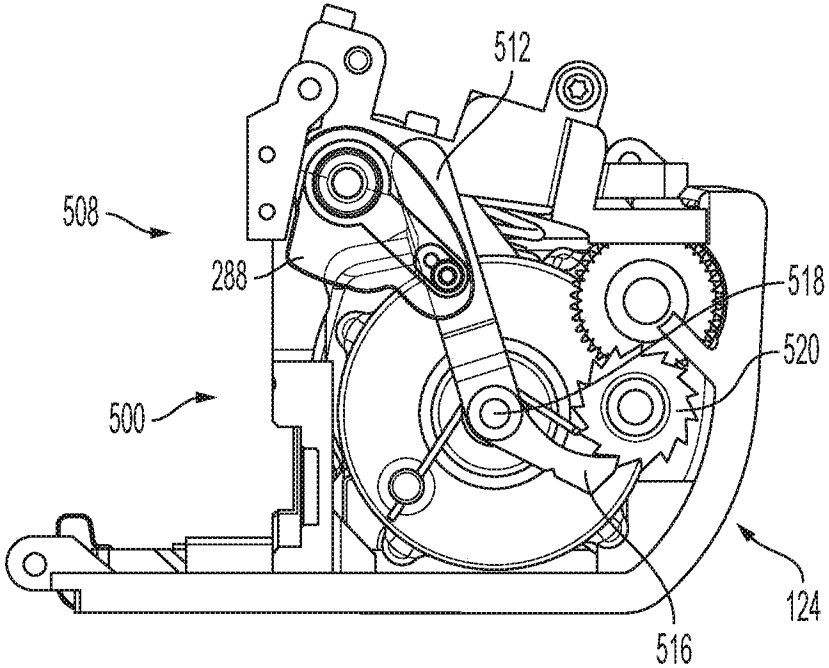
FIG. 12 is a side view of an example ratchet assembly of a strapping device in a first configuration.

Referring now to FIGS. 12 and 13, the strapping device 100 can include a back drive ratchet assembly 500. The back drive ratchet assembly 500 can release force from the strap 204 on the tensioner 120 prior to the actuator 272 lifting the tensioner 120 to facilitate lifting of the tensioner 120. The drive assembly 124 can include a wedge 288 fixed to the cam shaft 276. The wedge 288 can be rotated by the cam shaft 276 when the actuator 272 rotates the cam shaft 276. For example, responsive to operation of the cam shaft 276, the wedge 288 can be adjusted (e.g., rotated) from a first state 508 to a second state 510. The wedge 288 can be in contact with a ratchet 504 of the back drive ratchet assembly 500 that is fixed to the tensioner 120. The ratchet 504 can extend from a first ratchet end 512 in contact with the wedge 288 to a second end 516 in contact with a ratchet member 520 when the wedge 288 is in the first state 508. The ratchet 504 can be fixed to the tensioner 120 at a point 518 along the tensioner axis 328. A portion of the ratchet 504 extending from the point 518 to the first ratchet end 512 can be at an angle to a portion of the ratchet 504 extending from the point 518 to the second ratchet end 516. The ratchet member 520 can include a plurality of teeth 524 that can releasably engage the second ratchet end 516 to enable a ratcheting action. For example, each of the teeth 524 can include a first tooth edge 528 and a second tooth edge 532 that is longer than the corresponding first tooth edge 528. The ratchet member 520 can rotate in a first direction (e.g., counter-clockwise in the example depicted in FIG. 12) while in contact with the second ratchet end 516 as the second ratchet end 516 can slide along each second tooth edge 532, but the second ratchet end 516 prevents rotation of the ratchet member 520 in a second direction opposite the first direction (e.g., clockwise in the example depicted in FIG. 12). The ratchet member 520 can be coupled to the tensioner 120, including to the rotation member 388, such that a back force from the strap 204 on the tensioner 120 is prevented from driving the tensioner 120 backwards due to the engagement of the ratchet 504 and the ratchet member 520. When the wedge 288 is adjusted to the second state 510 (e.g., responsive to operation of the trigger 160), the wedge 288 applies a force against the first ratchet end 512 to rotate the first ratchet end 512 such that the second ratchet end 516 is moved away from the ratchet member 520, enabling the tensioner 120 to be lifted.

Figure 14:
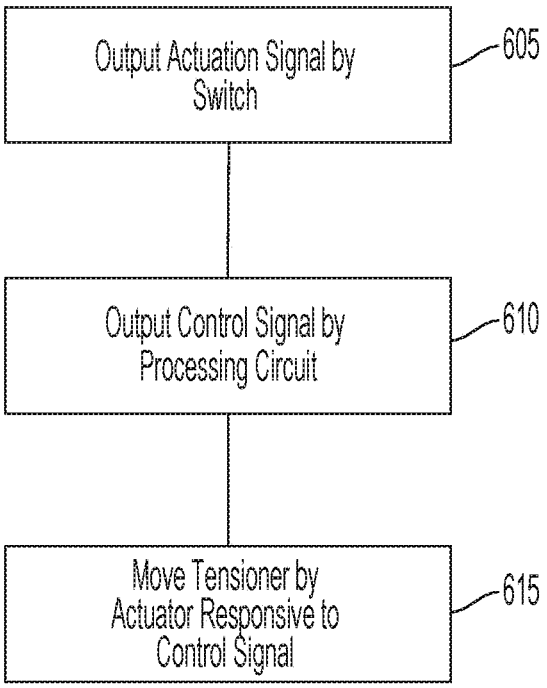
FIG. 14 is a flow diagram of an example method of operating a strapping device.

FIG. 14 depicts an example method 600 of operating a tool. The tool can include the strapping device 100 described with reference to FIGS. 1-13. At 605, a first switch of the tool outputs an actuation signal. The first switch can output the actuation signal responsive to a circuit of the first switch being closed. The first switch can output the actuation signal responsive to an input device of the tool, such as at least one of a trigger, a button, a lever, and a second switch, being adjusted from a first state spaced from the first switch to a second state in contact with the first switch to close the circuit of the first switch. The input device can be adjusted from the first state to the second state responsive to a trigger force applied to the trigger than is greater than a bias force applied to hold the input device away from the switch (e.g., by a biasing element such as a spring).

At 610, a processing circuit of the tool outputs a control signal responsive to receiving the actuation signal. The processing circuit can output the control signal to indicate instructions to cause movement and/operation of a remote component, such as a tensioner of the tool used to tension a strap received by the tool.

At 615, an actuator of the tool moves the tensioner, responsive to receiving the control signal, from a first tensioner position to a second tensioner position further from the base of the tool than the second tensioner position. The actuator can cause the tensioner to be moved based on a movement force that is greater than the bias force. The actuator can drive a shaft responsive to receiving the control signal. The actuator can include a servomotor that rotates the shaft. The actuator can have a torque that varies as a function of rotational position, and the actuator may rotate the shaft through a maximum torque position. For example, the servomotor may have a 180 degree range of motion, and may rotate the shaft through a 70 degree movement that includes a maximum torque position. A cam coupled with the shaft can move the tensioner from the first tensioner position to a second tensioner position. The cam may contact a lever arm of the tensioner to move the tensioner from the first tensioner position to the second tensioner position. Based on the rotation by the servomotor, the force that moves the tensioner from the first position to the second position can be the movement force that is greater than the bias force applied to the trigger. Moving the tensioner from the first tensioner position to the second tensioner position can move the tensioner away from a base of the tool along which a strap can be received, to allow the strap to be positioned between the tensioner and the base or remove the strap from between the tensioner and the base.

While operations are depicted in the drawings in a particular order, such operations are not required to be performed in the particular order shown or in sequential order, and all illustrated operations are not required to be performed. Actions described herein can be performed in a different order.

Having now described some illustrative implementations, it is apparent that the foregoing is illustrative and not limiting, having been presented by way of example. In particular, although many of the examples presented herein involve specific combinations of method acts or system elements, those acts and those elements can be combined in other ways to accomplish the same objectives. Acts, elements and features discussed in connection with one implementation are not intended to be excluded from a similar role in other implementations or implementations.

The phraseology and terminology used herein is for the purpose of description and should not be regarded as limiting. The use of "including" "comprising" "having" "containing" "involving" "characterized by" "characterized in that" and variations thereof herein, is meant to encompass the items listed thereafter, equivalents thereof, and additional items, as well as alternate implementations consisting of the items listed thereafter exclusively. In one implementation, the systems and methods described herein consist of one, each combination of more than one, or all of the described elements, acts, or components.

Any references to implementations or elements or acts of the systems and methods herein referred to in the singular can also embrace implementations including a plurality of these elements, and any references in plural to any implementation or element or act herein can also embrace implementations including only a single element. References in the singular or plural form are not intended to limit the presently disclosed systems or methods, their components, acts, or elements to single or plural configurations. References to any act or element being based on any information, act or element can include implementations where the act or element is based at least in part on any information, act, or element.

Any implementation disclosed herein can be combined with any other implementation or embodiment, and references to "an implementation," "some implementations," "one implementation" or the like are not necessarily mutually exclusive and are intended to indicate that a particular feature, structure, or characteristic described in connection with the implementation can be included in at least one implementation or embodiment. Such terms as used herein are not necessarily all referring to the same implementation. Any implementation can be combined with any other implementation, inclusively or exclusively, in any manner consistent with the aspects and implementations disclosed herein.

Where technical features in the drawings, detailed description or any claim are followed by reference signs, the reference signs have been included to increase the intelligibility of the drawings, detailed description, and claims. Accordingly, neither the reference signs nor their absence have any limiting effect on the scope of any claim elements.

Systems and methods described herein may be embodied in other specific forms without departing from the characteristics thereof. Further relative parallel, perpendicular, vertical or other positioning or orientation descriptions include variations within +/−10% or +/−10 degrees of pure vertical, parallel or perpendicular positioning. References to "approximately," "about" "substantially" or other terms of degree include variations of +/−10% from the given measurement, unit, or range unless explicitly indicated otherwise. Coupled elements can be electrically, mechanically, or physically coupled with one another directly or with intervening elements. Scope of the systems and methods described herein is thus indicated by the appended claims, rather than the foregoing description, and changes that come within the meaning and range of equivalency of the claims are embraced therein.

The term "coupled" and variations thereof includes the joining of two members directly or indirectly to one another. Such joining may be stationary (e.g., permanent or fixed) or moveable (e.g., removable or releasable). Such joining may be achieved with the two members coupled directly to each other, with the two members coupled with each other using a separate intervening member and any additional intermediate members coupled with one another, or with the two members coupled with each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

References to "or" can be construed as inclusive so that any terms described using "or" can indicate any of a single, more than one, and all of the described terms. For example, a reference to "at least one of 'A' and 'B'" can include only 'A', only 'B', as well as both 'A' and 'B'. Such references used in conjunction with "comprising" or other open terminology can include additional items.

Modifications of described elements and acts such as variations in sizes, dimensions, structures, shapes and proportions of the various elements, values of parameters, mounting arrangements, use of materials, colors, orientations can occur without materially departing from the teachings and advantages of the subject matter disclosed herein. For example, elements shown as integrally formed can be constructed of multiple parts or elements, the position of elements can be reversed or otherwise varied, and the nature or number of discrete elements or positions can be altered or varied. Other substitutions, modifications, changes and omissions can also be made in the design, operating conditions and arrangement of the disclosed elements and operations without departing from the scope of the present disclosure.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

The hardware and data processing components used to implement the various processes, operations, illustrative logics, logical blocks, modules and circuits described in connection with the embodiments disclosed herein may be implemented or performed with a general purpose single- or multi-chip processor, a digital signal processor (DSP), an application specific integrated circuit (ASIC), a field programmable gate array (FPGA), or other programmable logic device, discrete gate or transistor logic, discrete hardware components, or any combination thereof designed to perform the functions described herein. A general purpose processor may be a microprocessor, or, any conventional processor, controller, microcontroller, or state machine. A processor also may be implemented as a combination of computing devices, such as a combination of a DSP and a microprocessor, a plurality of microprocessors, one or more microprocessors in conjunction with a DSP core, or any other such configuration. In some embodiments, particular processes and methods may be performed by circuitry that is specific to a given function. The memory (e.g., memory, memory unit, storage device) may include one or more devices (e.g., RAM, ROM, Flash memory, hard disk storage) for storing data or computer code for completing or facilitating the various processes, layers and modules described in the present disclosure. The memory may be or include volatile memory or non-volatile memory, and may include database components, object code components, script components, or any other type of information structure for supporting the various activities and information structures described in the present disclosure. According to an exemplary embodiment, the memory is communicably connected to the processor via a processing circuit and includes computer code for executing (e.g., by the processing circuit or the processor) the one or more processes described herein.

The embodiments of the present disclosure may be implemented using computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. Combinations of the above are also included within the scope of machine-readable media. Machine-executable instructions include, for example, instructions and data which cause a general purpose computer, special purpose computer, or special purpose processing machines to perform a certain function or group of functions.

Although the figures and description may illustrate a specific order of method steps, the order of such steps may differ from what is depicted and described, unless specified differently above. Also, two or more steps may be performed concurrently or with partial concurrence, unless specified differently above. Such variation may depend, for example, on the software and hardware systems chosen and on designer choice. All such variations are within the scope of the disclosure. Likewise, software implementations of the described methods could be accomplished with standard programming techniques with rule-based logic and other logic to accomplish the various connection steps, processing steps, comparison steps, and decision steps.

What is claimed is:

1. A strapping device, comprising:

a body;

a base;

a tensioning wheel;

a handle including a bottom portion facing in a first downward direction and a top portion facing in a first upward direction;

an input device positioned at the bottom portion of the handle, the input device comprising at least one of a trigger or a button having an input device surface to receive a finger of a user, the input device surface having a length of less than three inches and facing in a second downward direction, the input device to move from a first state to a second state;

a linkage assembly, responsive to movement of the input device from the first state to the second state to move the tensioning wheel from a first tensioning wheel position to a second tensioning wheel position further from the base than the first tensioning wheel position;

a spring to apply a bias force to bias the input device toward the first state, the input device to move from the first state to the second state responsive to receipt of a movement force greater than the bias force, and the tensioning wheel to move from the first tensioning wheel position to the second tensioning wheel position based on the movement force greater than the bias force;

the input device, responsive to the movement force greater than the bias force, to cause a switch to output a signal as the input device moves from the first state to the second state; and a tensioning user interface element on a top of the body facing in a second upward direction, the tensioning user interface element to output a tension signal and having an upper surface angled downward along a first direction from a front of the body towards a back of the body; and a DC drive motor to cause rotation of the tensioning wheel based on the tension signal.

2. The strapping device of claim 1, comprising:

a lever arm to move from a first lever position to a second lever position responsive to the movement of the input device from the first state to the second state, the movement of the lever arm being in connection with the tensioning wheel movement from the first tensioning wheel position to the second tensioning wheel position.

3. The strapping device of claim 1, comprising:

a stop, operably coupled with a lever arm, to cause the tensioning wheel to move from the first tensioning wheel position to the second tensioning wheel position.

4. The strapping device of claim 1, comprising:

a stop to lift from a first stop position to a second stop position to cause the tensioning wheel to move from the first tensioning wheel position to the second tensioning wheel position.

5. The strapping device of claim 1, comprising:

a lever arm fixedly positioned relative to the tensioning wheel.

6. The strapping device of claim 1, comprising:

a lever arm fixed to a stop.

7. The strapping device of claim 1, comprising:

a battery positioned at a first end portion of the body and the tensioning wheel positioned at a second end portion of the body opposite to the first end portion.

8. A strapping device, comprising:

a body including a base and a tensioning wheel;

a handle coupled with the body;

an input device positioned at a bottom portion of the handle, the input device comprising at least one of a trigger or a button, the input device to move from a first state to a second state;

a linkage assembly, responsive to movement of the input device from the first state to the second state to move the tensioning wheel from a first tensioning wheel position to a second tensioning wheel position further from the base than the first tensioning wheel position;

a spring to apply a bias force to bias the input device toward the first state, the input device to move from the first state to the second state responsive to receipt of a movement force greater than the bias force, and the tensioning wheel to move from the first tensioning wheel position to the second tensioning wheel position based on the movement force greater than the bias force;

the input device, responsive to the movement force greater than the bias force, to cause a switch to output a signal as the input device moves from the first state to the second state; and a tensioning user interface element to output, when actuated, a tension signal; and a DC drive motor to cause rotation of the tensioning wheel.

9. The strapping device of claim 8, comprising:

a plurality of planetary gears coupled with the DC drive motor to cause rotation of the tensioning wheel.

10. The strapping device of claim 8, comprising:

a first gear coupled with the DC drive motor to be rotated about a drive axis of the DC drive motor, the drive axis is not coaxial with a tensioner axis about which the tensioning wheel rotates; and a second gear coupled with the first gear and the tensioning wheel to cause rotation of the tensioning wheel about the tensioner axis.

11. The strapping device of claim 8, comprising:

a battery removably received in the body.

12. The strapping device of claim 8, comprising:

a user interface coupled with the body, the user interface to receive user input and present information regarding operation of the strapping device.

13. The strapping device of claim 8, comprising:

a user interface coupled with the body, the user interface to receive user input and present information regarding at least one of tensioning or welding being performed by the strapping device.

14. The strapping device of claim 8, comprising: a communications circuit to:

output information regarding the strapping device; and to receive operational information.

15. A strapping device, comprising:

a body;

a base;

a tensioning wheel;

a handle;

an input device positioned at a bottom portion of the handle, the input device comprising at least one of a trigger or a button having an input device surface having a length of less than three inches, the input device to move from a first state to a second state;

a linkage assembly, responsive to movement of the input device from the first state to the second state to move the tensioning wheel from a first tensioning wheel position to a second tensioning wheel position further from the base than the first tensioning wheel position;

a spring to apply a bias force to bias the input device toward the first state, the input device to move from the first state to the second state responsive to receipt of a movement force greater than the bias force, and the tensioning wheel to move from the first tensioning wheel position to the second tensioning wheel position based on the movement force greater than the bias force;

the input device, responsive to the movement force greater than the bias force, to cause a switch to output a signal as the input device moves from the first state to the second state; and a tensioning user interface element on a top of the body facing in an upward direction, the tensioning user interface element to output a tension signal, and having an upper surface angled downward along a first direction from a front of the body towards a back of the body; and a second user interface element on the top of the body facing in the upward direction.

16. The strapping device of claim 15, comprising:

the second user interface element configured to actuate to cause two overlapping parts of a steel strap to be secured together.

17. The strapping device of claim 15, comprising:

the tensioning user interface element to actuate a first user interface element switch to output the tension signal; and the second user interface element to actuate a second user interface element switch to cause two overlapping parts of a strap to be secured together.

18. The strapping device of claim 17, wherein the tensioning user interface element and the second user interface element are positioned adjacent to each other.

19. The strapping device of claim 15, wherein:

the tensioning user interface element is spaced from the input device such that a user can manipulate the input device with a finger of one hand of the user and also manipulate the tensioning user interface element with the one hand without moving the finger.

20. The strapping device of claim 15, comprising:

a communications circuit that includes a wired interface to output the status information.

21. The strapping device of claim 15, comprising:

the linkage assembly configured to move the tensioning wheel to the first tensioning wheel position responsive to operation of the input device.

22. A strapping device, comprising:

a body including a base and a tensioning wheel;

a handle coupled with the body, the handle including a bottom portion facing in a first downward direction and a top portion facing in a first upward direction;

an input device positioned at the bottom portion of the handle, the input device comprising at least one of a trigger or a button having an input device surface to receive a finger of a user, the input device surface having a length of less than three inches and facing in a second downward direction, the input device to move from a first state to a second state;

a linkage assembly, responsive to movement of the input device from the first state to the second state to move the tensioning wheel from a first tensioning wheel position to a second tensioning wheel position further from the base than the first tensioning wheel position;

a spring to apply a bias force to bias the input device toward the first state, the input device to move from the first state to the second state responsive to receipt of a movement force greater than the bias force, and the tensioning wheel to move from the first tensioning wheel position to the second tensioning wheel position based on the movement force greater than the bias force;

the input device, responsive to the movement force greater than the bias force, to cause a switch to output a signal as the input device moves from the first state to the second state; and a tensioning user interface element on a top of the body facing in a second upward direction, the tensioning user interface element to output a tension signal, and having an upper surface angled downward along a first direction from a front of the body towards a back of the body;

a DC drive motor to cause rotation of the tensioning wheel based on the tension signal; and a display to provide information regarding the strapping device.

23. The strapping device of claim 22, comprising:

the linkage assembly configured to move the tensioning wheel to the first tensioning wheel position as the input device moves towards the first state.

24. The strapping device of claim 22, wherein the DC drive motor is an electric motor.

25. The strapping device of claim 22, wherein:

a top surface of the handle extends from a front of the handle to a back of the handle, a middle half of the top surface of the handle having a leftmost point and a rightmost point; and a line that extends through the leftmost point and the rightmost point is angled relative to a strap axis of the base.

26. The strapping device of claim 22, comprising:

a top surface of the handle that extends from a front of the handle to a back of the handle, a substantially entire middle half of the top surface of the handle curved along the first direction.

27. The strapping device of claim 22, comprising:

a top surface of the handle that extends from a front of the handle to a back of the handle, the top surface of the handle curved in the first direction at least at one point in a middle half of the top surface.

28. The strapping device of claim 22, wherein a first distance from a frontmost point of the tensioning user interface element to a frontmost point of the strapping device is less than a second distance from a frontmost point of the input device surface to the frontmost point of the strapping device.

29. The strapping device of claim 22, wherein a frontmost point of the tensioning user interface element is farther forward toward a front of the strapping device than a frontmost point of the input device surface is to the front of the strapping device.

30. The strapping device of claim 22, comprising:

an exposed portion of the input device surface having a concave shape to receive the finger of the user.

* * * * *